US008473127B2

(12) United States Patent
Daum et al.

(10) Patent No.: US 8,473,127 B2
(45) Date of Patent: Jun. 25, 2013

(54) SYSTEM, METHOD AND COMPUTER SOFTWARE CODE FOR OPTIMIZING TRAIN OPERATIONS CONSIDERING RAIL CAR PARAMETERS

(75) Inventors: Wolfgang Daum, Erie, PA (US); John Erik Hershey, Ballston Lake, NY (US); David Michael Peltz, Melbourne, FL (US); Glenn Robert Shaffer, Erie, PA (US); Joseph Forrest Noffsinger, Lees Summit, MO (US); John Borntraeger, Melbourne, FL (US); Ajith Kumar, Erie, PA (US)

(73) Assignee: General Electric Company, Schenectady, NY (US)

( * ) Notice: Subject to any disclaimer, the term of this patent is extended or adjusted under 35 U.S.C. 154(b) by 1419 days.

(21) Appl. No.: 11/621,221

(22) Filed: Jan. 9, 2007

(65) Prior Publication Data

US 2010/0262321 A1 Oct. 14, 2010

Related U.S. Application Data

(63) Continuation-in-part of application No. 11/385,354, filed on Mar. 20, 2006.

(60) Provisional application No. 60/802,147, filed on May 19, 2006.

(51) Int. Cl.
*G05D 1/00* (2006.01)

(52) U.S. Cl.
USPC ..... 701/19; 701/20; 701/482

(58) Field of Classification Search
USPC ..... 701/19, 20, 200, 201, 202, 205, 209
See application file for complete search history.

(56) References Cited

U.S. PATENT DOCUMENTS

| | | | |
|---|---|---|---|
| 2,104,652 | A | 1/1938 | Inman |
| 2,601,634 | A | 6/1952 | Rivette |
| 2,927,711 | A | 3/1960 | Naggiar |
| 3,519,805 | A | 7/1970 | Thorne-Booth |
| 3,650,216 | A | 3/1972 | Harwick et al. |
| 3,655,962 | A | 4/1972 | Koch |
| 3,781,139 | A | 12/1973 | Lohse |

(Continued)

FOREIGN PATENT DOCUMENTS

| | | |
|---|---|---|
| CH | 642 418 | 4/1984 |
| DE | 197 26 542 | 11/1998 |

(Continued)

OTHER PUBLICATIONS

Razouqi et al. RYNSORD: A Novel, Decentralized Algorithm for Railway Networks with 'Soft Reservation', VTC, 1998, pp. 1585-2589, V3, New York, NY.

(Continued)

*Primary Examiner* — James Trammell
*Assistant Examiner* — Jerrah Edwards
(74) *Attorney, Agent, or Firm* — GE Global Patent Operation; John A. Kramer

(57) ABSTRACT

A method for improving train performance, the method including determining a rail car parameter for at least one rail car to be included in a train, and creating a train trip plan based on the rail car parameter in accordance with one or more operational criteria for the train.

39 Claims, 11 Drawing Sheets

U.S. PATENT DOCUMENTS 3,794,833 A 2/1974 Blazek et al.
3,865,042 A 2/1975 DePaola et al.
3,886,870 A 6/1975 Pelabon
3,948,314 A 4/1976 Creswick et al.
4,005,838 A 2/1977 Grundy
4,041,283 A 8/1977 Mosier
4,042,810 A 8/1977 Mosher
4,136,432 A 1/1979 Melley, Jr.
4,181,943 A 1/1980 Mercer, Sr.
4,253,399 A 3/1981 Spigarelli
4,279,395 A 7/1981 Boggio et al.
4,344,364 A 8/1982 Nickles et al.
4,401,035 A 8/1983 Spigarelli et al.
4,548,164 A 10/1985 Ylonen et al.
4,561,057 A 12/1985 Haley, Jr. et al.
4,602,335 A 7/1986 Perlmutter
4,617,627 A 10/1986 Yasunobu et al.
4,644,705 A 2/1987 Saccomani et al.
4,663,713 A 5/1987 Cornell et al.
4,711,418 A 12/1987 Aver, Jr. et al.
4,735,385 A 4/1988 Nickles et al.
4,794,548 A 12/1988 Lynch et al.
4,827,438 A 5/1989 Nickles et al.
4,843,575 A 6/1989 Crane
4,853,883 A 8/1989 Nickles et al.
5,109,343 A 4/1992 Budway
5,181,541 A 1/1993 Bodenheimer
5,187,945 A 2/1993 Dixon
5,197,627 A 3/1993 Disabato et al.
5,239,472 A 8/1993 Long et al.
5,240,416 A 8/1993 Bennington
5,253,153 A 10/1993 Mathews et al.
5,316,174 A 5/1994 Schutz
5,363,787 A 11/1994 Konopasek et al.
5,388,034 A 2/1995 Allen et al.
5,398,894 A 3/1995 Pascoe
5,437,422 A 8/1995 Newman
5,440,489 A 8/1995 Newman
5,460,013 A 10/1995 Thomsen
5,487,516 A 1/1996 Murata et al.
5,623,413 A 4/1997 Matheson et al.
5,642,827 A 7/1997 Madsen
5,651,330 A 7/1997 Jewett
5,676,059 A 10/1997 Alt
5,744,707 A 4/1998 Kull
5,755,349 A 5/1998 Brundle
5,758,299 A 5/1998 Sandborg et al.
5,785,392 A 7/1998 Hart
5,794,172 A 8/1998 Matheson et al.
5,803,411 A * 9/1998 Ackerman et al. ..... 246/169 R
5,828,979 A 10/1998 Polivka et al.
5,950,967 A 9/1999 Montgomery
5,957,571 A 9/1999 Koster et al.
5,998,915 A 12/1999 Scholz et al.
6,092,021 A 7/2000 Ehlbeck et al.
6,112,142 A 8/2000 Shockley et al.
6,123,111 A 9/2000 Nathan et al.
6,125,311 A 9/2000 Lo
6,129,025 A 10/2000 Minakami et al.
6,144,901 A * 11/2000 Nickles et al. ..... 701/19
6,198,993 B1 3/2001 Higashi et al.
6,216,957 B1 4/2001 Turunen, Jr.
6,230,668 B1 5/2001 Marsh
6,243,694 B1 6/2001 Bonissone
6,263,266 B1 7/2001 Hawthorne
6,269,034 B1 7/2001 Shibuya
6,270,040 B1 8/2001 Katzer
6,308,117 B1 10/2001 Ryland et al.
6,325,050 B1 12/2001 Gallagher et al.
6,332,106 B1 12/2001 Hawthorne et al.
6,363,331 B1 * 3/2002 Kyrtsos ..... 702/175
6,380,639 B1 4/2002 Soucy
6,404,129 B1 6/2002 Hendricx et al.
6,434,452 B1 8/2002 Gray
6,459,964 B1 10/2002 Vu et al.
6,487,488 B1 11/2002 Peterson, Jr. et al.
6,505,103 B1 1/2003 Howell et al.
6,516,727 B2 2/2003 Kraft
6,520,124 B2 2/2003 Bohm, II
6,549,803 B1 4/2003 Raghavan et al.
6,591,758 B2 7/2003 Kumar
6,609,049 B1 8/2003 Kane et al.
6,612,245 B2 9/2003 Kumar et al.
6,612,246 B2 9/2003 Kumar
6,615,118 B2 9/2003 Kumar
6,647,328 B2 11/2003 Walker
6,676,089 B1 1/2004 Katzer
6,691,957 B2 2/2004 Hess, Jr. et al.
6,694,231 B1 2/2004 Rezk
6,698,913 B2 3/2004 Yamamoto
6,702,235 B2 3/2004 Katzer
6,732,023 B2 5/2004 Sugita et al.
6,763,291 B1 7/2004 Houpt et al.
6,789,005 B2 9/2004 Hawthorne
6,810,312 B2 10/2004 Jammu et al.
6,824,110 B2 11/2004 Kane et al.
6,845,953 B2 1/2005 Kane et al.
6,853,888 B2 2/2005 Kane et al.
6,856,865 B2 2/2005 Hawthorne
6,863,246 B2 3/2005 Kane et al.
6,865,454 B2 3/2005 Kane et al.
6,873,888 B2 3/2005 Kumar
6,903,658 B2 6/2005 Kane et al.
6,910,792 B2 6/2005 Takada et al.
6,915,191 B2 7/2005 Kane et al.
6,922,619 B2 7/2005 Baig et al.
6,948,837 B2 9/2005 Suzuki
6,953,272 B2 10/2005 Hayakawa et al.
6,957,131 B2 10/2005 Kane et al.
6,973,947 B2 12/2005 Penaloza et al.
6,978,195 B2 12/2005 Kane et al.
6,980,894 B1 12/2005 Gordon et al.
6,996,461 B2 2/2006 Kane et al.
7,021,588 B2 4/2006 Hess, Jr. et al.
7,021,589 B2 4/2006 Hess, Jr. et al.
7,024,289 B2 4/2006 Kane et al.
7,036,774 B2 5/2006 Kane et al.
7,072,747 B2 7/2006 Armbruster et al.
7,072,757 B2 7/2006 Adams et al.
7,073,753 B2 * 7/2006 Root et al. ..... 246/72
7,079,926 B2 7/2006 Kane et al.
7,092,800 B2 8/2006 Kane et al.
7,092,801 B2 8/2006 Kane et al.
7,096,171 B2 8/2006 Hawthorne et al.
7,127,336 B2 * 10/2006 Houpt et al. ..... 701/19
7,131,403 B1 11/2006 Banga et al.
7,164,975 B2 1/2007 Bidaud
7,302,895 B2 12/2007 Kumar et al.
7,347,168 B2 3/2008 Reckels et al.
7,349,797 B2 3/2008 Donnelly et al.
7,497,201 B2 3/2009 Hollenbeck
7,500,436 B2 3/2009 Kumar et al.
7,509,193 B2 3/2009 Kustosch
7,522,990 B2 4/2009 Daum et al.
7,618,011 B2 11/2009 Oleski et al.
7,667,611 B2 2/2010 Lindsey et al.
2001/0029411 A1 10/2001 Hawthorne
2001/0047241 A1 11/2001 Khavakh et al.
2002/0059075 A1 5/2002 Schick et al.
2002/0072833 A1 6/2002 Gray
2002/0093201 A1 7/2002 Soucy
2002/0096081 A1 7/2002 Kraft
2002/0107618 A1 8/2002 Deguchi et al.
2002/0174653 A1 11/2002 Uzkan
2003/0001050 A1 1/2003 Katzer
2003/0034423 A1 2/2003 Hess et al.
2003/0076221 A1 4/2003 Akiyama et al.
2003/0091017 A1 5/2003 Davenport et al.
2003/0104899 A1 6/2003 Keller
2003/0105561 A1 6/2003 Nickles et al.
2003/0120400 A1 6/2003 Ahmed et al.
2003/0183729 A1 10/2003 Root et al.
2003/0213875 A1 11/2003 Hess, Jr. et al.
2003/0222981 A1 12/2003 Kisak et al.
2003/0229446 A1 12/2003 Boscamp et al.
2003/0233959 A1 12/2003 Kumar
2004/0068359 A1 4/2004 Neiss et al.

| | | | | |
|---|---|---|---|---|
| 2004/0098142 | A1 | 5/2004 | Warren et al. | |
| 2004/0104312 | A1 | 6/2004 | Hess et al. | |
| 2004/0108814 | A1 | 6/2004 | Tsuda et al. | |
| 2004/0122569 | A1 | 6/2004 | Bidaud | |
| 2004/0129289 | A1 | 7/2004 | Hafemann | |
| 2004/0133315 | A1 | 7/2004 | Kumar et al. | |
| 2004/0172175 | A1 | 9/2004 | Julich et al. | |
| 2004/0174121 | A1 | 9/2004 | Tsuda et al. | |
| 2004/0245410 | A1 * | 12/2004 | Kisak et al. | 246/3 |
| 2005/0007020 | A1 | 1/2005 | Tsuda et al. | |
| 2005/0055287 | A1 | 3/2005 | Schmidtberg et al. | |
| 2005/0065674 | A1 | 3/2005 | Houpt et al. | |
| 2005/0085961 | A1 | 4/2005 | Kane et al. | |
| 2005/0109882 | A1 | 5/2005 | Armbruster et al. | |
| 2005/0120904 | A1 | 6/2005 | Kumar et al. | |
| 2005/0121005 | A1 | 6/2005 | Edwards | |
| 2005/0171655 | A1 | 8/2005 | Flynn et al. | |
| 2005/0171657 | A1 | 8/2005 | Kumar | |
| 2005/0188745 | A1 | 9/2005 | Staphanos et al. | |
| 2005/0196737 | A1 | 9/2005 | Mann | |
| 2005/0205719 | A1 | 9/2005 | Hendrickson et al. | |
| 2005/0251299 | A1 | 11/2005 | Donnelly et al. | |
| 2005/0288832 | A1 | 12/2005 | Smith et al. | |
| 2006/0041341 | A1 | 2/2006 | Kane et al. | |
| 2006/0047379 | A1 | 3/2006 | Schullian et al. | |
| 2006/0060345 | A1 | 3/2006 | Filk et al. | |
| 2006/0085103 | A1 | 4/2006 | Smith et al. | |
| 2006/0085363 | A1 | 4/2006 | Cheng et al. | |
| 2006/0116789 | A1 | 6/2006 | Subramanian et al. | |
| 2006/0116795 | A1 | 6/2006 | Abe et al. | |
| 2006/0122737 | A1 | 6/2006 | Tani et al. | |
| 2006/0155434 | A1 | 7/2006 | Kane et al. | |
| 2006/0162973 | A1 | 7/2006 | Harris et al. | |
| 2006/0212188 | A1 | 9/2006 | Kickbusch et al. | |
| 2006/0277906 | A1 | 12/2006 | Burk et al. | |
| 2006/0282199 | A1 | 12/2006 | Daum et al. | |
| 2007/0061053 | A1 | 3/2007 | Zeitzew | |
| 2007/0112475 | A1 | 5/2007 | Koebler et al. | |
| 2007/0219680 | A1 | 9/2007 | Kumar et al. | |
| 2007/0219681 | A1 | 9/2007 | Kumar et al. | |
| 2007/0219683 | A1 | 9/2007 | Daum et al. | |
| 2007/0233364 | A1 | 10/2007 | Kumar et al. | |
| 2007/0260369 | A1 | 11/2007 | Philp et al. | |
| 2007/0261648 | A1 | 11/2007 | Reckels et al. | |
| 2008/0004721 | A1 | 1/2008 | Huff et al. | |
| 2008/0128563 | A1 | 6/2008 | Kumar et al. | |
| 2008/0147256 | A1 | 6/2008 | Liberatore | |
| 2008/0208393 | A1 | 8/2008 | Schricker | |
| 2009/0140574 | A1 | 6/2009 | Gorman et al. | |
| 2009/0177345 | A1 | 7/2009 | Severinsky et al. | |
| 2009/0254239 | A1 | 10/2009 | Daum et al. | |
| 2009/0319092 | A1 | 12/2009 | Piche | |
| 2010/0152998 | A1 | 6/2010 | Schwarzmann | |

FOREIGN PATENT DOCUMENTS

| | | |
|---|---|---|
| DE | 19830053 | 11/1999 |
| DE | 198 30 353 | 2/2001 |
| DE | 199 35 349 | 2/2001 |
| DE | 199 35 353 | 2/2001 |
| DE | 19935353 | 2/2001 |
| DE | 100 45 921 | 3/2002 |
| EP | 0 594 226 | 9/1990 |
| EP | 0 428 113 | 11/1990 |
| EP | 1 136 969 | 7/2002 |
| EP | 1 297 982 | 4/2003 |
| EP | 1 466 803 | 10/2004 |
| EP | 1 253 059 | 8/2006 |
| FR | 2 129 215 | 10/1972 |
| FR | 2 558 806 | 1/1984 |
| FR | 2 767 770 | 9/1997 |
| GB | 482 625 | 12/1936 |
| JP | 60 028153 | 2/1985 |
| JP | 50-32733 | 9/1993 |
| JP | 06-108869 | 4/1994 |
| JP | 2001-065360 | 3/2001 |
| WO | WO 95/25053 | 9/1995 |
| WO | WO 99/14093 | 3/1999 |
| WO | WO 03/097424 | 11/2003 |
| WO | WO 2004/023517 | 3/2004 |
| WO | WO 2004/051699 | 6/2004 |
| WO | WO 2004/051700 | 6/2004 |
| WO | WO 2004/052755 | 6/2004 |
| WO | WO2004/059446 | 7/2004 |
| WO | WO 2004/059446 | 7/2004 |
| WO | WO 2005/061300 | 7/2005 |
| WO | WO 2007/027130 | 3/2007 |
| WO | WO 2007/091270 | 8/2007 |

OTHER PUBLICATIONS

ISR and WO pertaining to International application No. PCT/US2009/032933 dated Nov. 3, 2009.

Chang et al. "Cycle Detection in Repair-Based Railway Scheduling System", Robotics and Automation, 1996 pp. 2517-2522, V3, New York, NY.

Grabs, Ulrike, "Modification of Electronic Interlocking El S in Service", Signal + Draht, Telzlaff Verlag GmbH, 1995, pp. 254-258, V87(7/08), Darmstadt, DE.

Cheng, Yu, "Hybrid Simulation for Resolving Resource conflicts in Train Traffic Rescheduling", Computers in Industry, 1998, pp. 233-246, V35(3), Amsterdam, NL.

ISR and WO pertaining to International application No. PCT US2006/032893 dated Aug. 24, 2006.

ISR and WO pertaining to International application No. PCT/US2007/001428 dated Jan. 18, 2007.

ISR and WO pertaining to International application No. PCT/US2007/066697 dated Apr. 16, 2007.

ISR and WO pertaining to International application No. PCT/US2007/076699 dated Aug. 24, 2007.

ISR and WO pertaining to International application No. PCT/US2007/078001 dated Sep. 10, 2007.

ISR and WO pertaining to International application No. PCT/US2007/078016 dated Sep. 10, 2007.

ISR and WO pertaining to International application No. PCT/US2007/078118 dated Sep. 11, 2007.

ISR and WO pertaining to International application No. PCT/US2007/078340 dated Sep. 13, 2007.

ISR and WO pertaining to International application No. PCT/US2008/063193 dated May 9, 2008.

ISR and WO pertaining to International application No. PCT/US2008/083526 dated Nov. 14, 2008.

ISR and WO pertaining to International application No. PCT/US2009/031740 dated Jan. 23, 2009.

ISR and WO pertaining to International application No. PCT/US2009/032933 dated Feb. 3, 2009.

ISR and WO pertaining to International application No. PCT/US2009/037293 dated Mar. 16, 2009.

ISR and WO pertaining to International application No. PCT/US2009/045004 dated May 22, 2009.

ISR pertaining to International application No. PCT/US2010/035058 dated May 17, 2010.

ISR pertaining to International application No. PCT/US2010/047251 dated Aug. 31, 2010.

* cited by examiner

SYSTEM, METHOD AND COMPUTER SOFTWARE CODE FOR OPTIMIZING TRAIN OPERATIONS CONSIDERING RAIL CAR PARAMETERS

This application is based on Provisional Application No. 60/802,147 filed May 19, 2006, and is a Continuation-In-Part of U.S. application Ser. No. 11/385,354 filed Mar. 20, 2006, the contents of which are incorporated herein by reference in its entirety.

FIELD OF INVENTION

The field of invention relates to rail transportation, and, in particular, for identifying rail car parameters for use in improving train operations.

BACKGROUND OF THE INVENTION

Locomotives are complex systems with numerous subsystems, with each subsystem being interdependent on other subsystems. An operator is aboard a locomotive to insure the proper operation of the locomotive and its associated load of freight cars. In addition to insuring proper operations of the locomotive the operator also is responsible for determining operating speeds of the train and for limiting forces to acceptable values within the train that the locomotives are part of. To perform this function, the operator generally must have extensive experience with operating the locomotive and various trains over the specified terrain. This knowledge is needed to comply with perscribeable operating speeds that may vary with the train location along the track. Moreover, the operator is also responsible for assuring in-train forces remain within acceptable limits.

Rail yards are the hubs of railroad transportation systems. Rail yards perform many services, for example, freight origination, interchange and termination, locomotive storage and maintenance, assembly and inspection of new trains, servicing of trains running through the facility, inspection and maintenance of railcars, and railcar storage. The various services in a rail yard compete for resources such as personnel, equipment, and space in various facilities so that managing the entire rail yard efficiently is a complex operation.

Assembling new trains usually involves assembling based on times trainloads are due at a given destination as well as motive power available for the given train. Typically when assembling a train, the placement of rail cars in the train may be done randomly. More specifically, car arrangement is not performed based on an order that may best optimize train operations. Train trip optimization may be improved knowing such information as car weight, load, wheel axial, lateral and/or vertical forces. This type of information may help optimize certain aspects of train operations, such as but not limited to fuel/speed optimization for acceleration, deceleration, improved train handling of distributed power or non-distributed power trains, and/or improved emissions.

There is a continuing need to improve a train assembly process and improve locomotive operating parameters of a train to reduce fuel costs and over-road transit times. One approach as disclosed herein is to use rail car parameters when making up a train.

BRIEF DESCRIPTION OF THE INVENTION

Exemplary embodiment of the invention disclose a system, method, and computer software code for identifying rail car parameters for use in improving train operations. Towards this end, a method for improving train performance includes a step for determining a rail car parameter for at least one rail car to be included in a train. Another step includes creating a train trip plan based on the rail car parameter in accordance with at least one operational criteria for the train.

In another exemplary embodiment, a computer software code for use in a processor for improving train performance is disclosed. The computer software code includes a computer software module for determining a rail car parameter of at least one rail car of the train. Another computer software module is for creating a train trip plan based on the rail car parameter in accordance with at least one operational criteria for the train.

A system for improving train performance by determining rail car parameters is also disclosed. The system includes a rail car parameter measurement system. A central controller is also disclosed. A communication network for allowing communications between the measurement system and the central controller is further included. Rail car parameters measured and provided to the central controller that then determines a train make up profile for all rail cars in the train and/or a trip plan for the train mission based on the rail car parameters.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Figure 1:
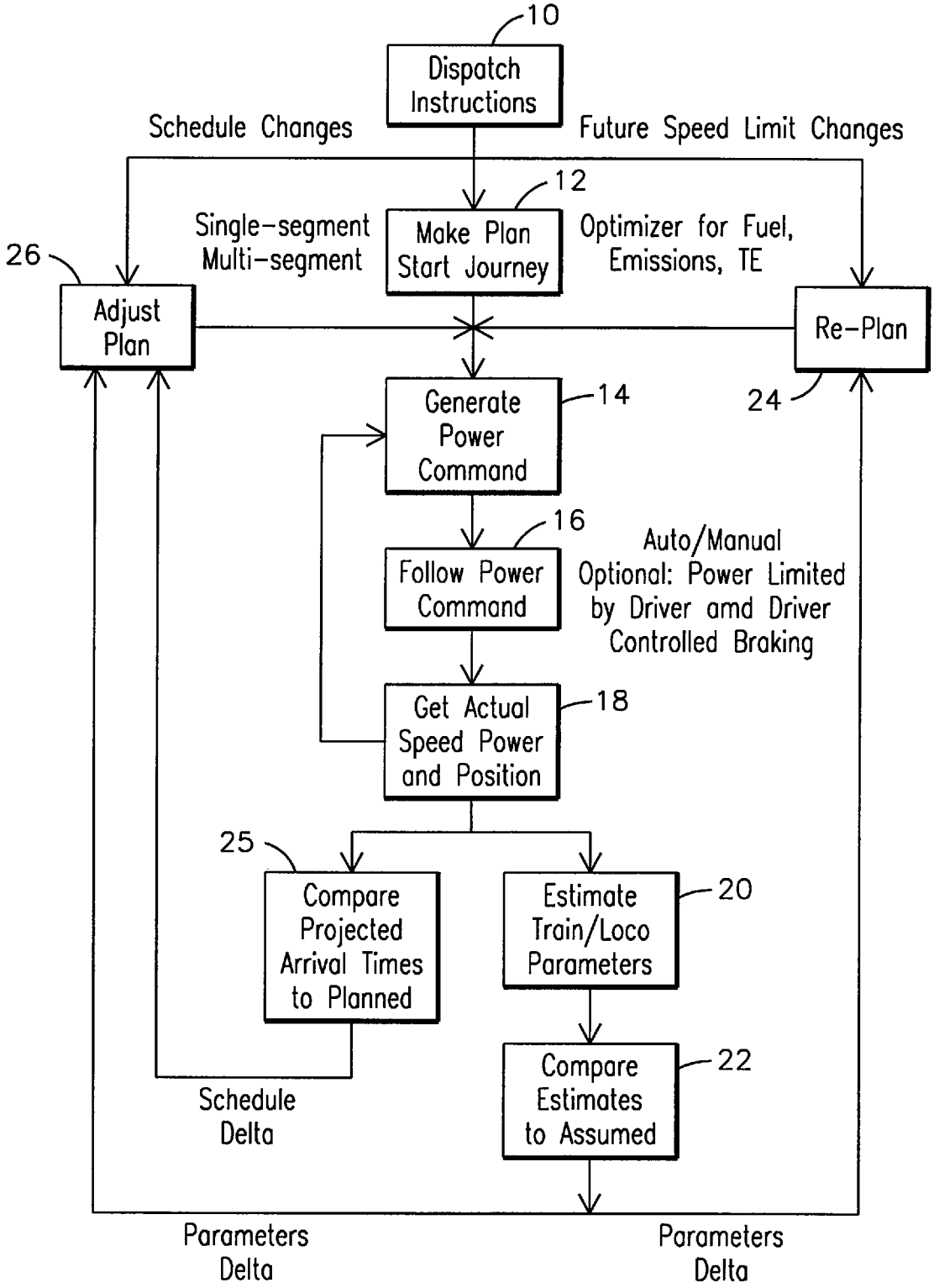
FIG. 1 depicts an exemplary illustration of a flow chart of the present invention.

Exemplary embodiments of the present invention solves the problems in the art by providing a system, method, and computer software code for identifying rail car parameters for use in improving train operations. Persons skilled in the art will recognize that an apparatus, such as a data processing system, including a CPU, memory, I/O, program storage, a connecting bus, and other appropriate components, could be programmed or otherwise designed to facilitate the practice of the method of an exemplary embodiment of the invention. Such a system would include appropriate program means for executing exemplary embodiments of the invention.

Broadly speaking, the technical effect is identifying rail car parameters and using these parameters in improving train operations. The invention may be described in the general context of computer-executable instructions, such as program modules, being executed by a computer. Generally, program modules may include routines, programs, objects, components, data structures, etc., that perform particular tasks or implement particular abstract data types. For example, the software programs that underlie exemplary embodiments of the invention can be coded in different languages, for use with different computing platforms. It will be appreciated, however, that the principles that underlie exemplary embodiments of the invention can be implemented with other types of computer software technologies as well.

Moreover, those skilled in the art will appreciate that the invention may be practiced with other computer system configurations, including hand-held devices, multiprocessor systems, microprocessor-based or programmable consumer electronics, minicomputers, mainframe computers, and the like. The invention may also be practiced in distributed computing environments where tasks are performed by remote processing devices that are linked through a communications network. In a distributed computing environment, program modules may be located in both local and remote computer storage media including memory storage devices.

Also, an article of manufacture, such as a pre-recorded disk or other similar computer program product, for use with a data processing system, could include a storage medium and program means recorded thereon for directing the data processing system to facilitate the practice of the method of the invention. Such apparatus and articles of manufacture also fall within the spirit and scope of the invention.

Throughout this document the term locomotive consist is used. As used herein, a locomotive consist may be described as having one or more locomotives in succession, connected together so as to provide motoring and/or braking capability. The locomotives are connected together where no train cars are in between the locomotives. The train can have more than one locomotive consists in its composition. Specifically, there can be a lead consist and more than one remote consists, such as midway in the line of cars and another remote consist at the end of the train. Each locomotive consist may have a first locomotive and trail locomotive(s). Though a first locomotive is usually viewed as the lead locomotive, those skilled in the art will readily recognize that the first locomotive in a multi locomotive consist may be physically located in a physically trailing position. Though a locomotive consist is usually viewed as successive locomotives, those skilled in the art will readily recognize that a consist group of locomotives may also be recognized as a consist even when at least a car separates the locomotives, such as when the locomotive consist is configured for distributed power operation, wherein throttle and braking commands are relayed from the lead locomotive to the remote trains by a radio link or physical cable. Towards this end, the term locomotive consist should be not be considered a limiting factor when discussing multiple locomotives within the same train.

Referring now to the drawings, embodiments of the present invention will be described. The invention can be implemented in numerous ways, including as a system (including a computer processing system), a method (including a computer implemented method), an apparatus, a computer readable medium, a computer program product, a graphical user interface, including a web portal, or a data structure tangibly fixed in a computer readable memory. Several embodiments of the invention are discussed below.

FIG. 1 depicts an exemplary illustration of a flow chart of an exemplary embodiment of the present invention. As illustrated, instructions are input specific to planning a trip either on board or from a remote location, such as a dispatch center 10. Such input information includes, but is not limited to, train position, consist description (such as locomotive models), locomotive power description, performance of locomotive traction transmission, consumption of engine fuel as a function of output power, cooling characteristics, the intended trip route (effective track grade and curvature as function of milepost or an "effective grade" component to reflect curvature following standard railroad practices), the train represented by car makeup and loading together with effective drag coefficients, trip desired parameters including, but not limited to, start time and location, end location, desired travel time, crew (user and/or operator) identification, crew shift expiration time, and route.

This data may be provided to the locomotive 42 in a number of ways, such as, but not limited to, an operator manually entering this data into the locomotive 42 via an onboard display, inserting a memory device such as a hard card and/or USB drive containing the data into a receptacle aboard the locomotive, and transmitting the information via wireless communication from a central or wayside location 41 (as disclosed in FIG. 3), such as a track signaling device and/or a wayside device, to the locomotive 42. Locomotive 42 and train 31 load characteristics (e.g., drag) may also change over the route (e.g., with altitude, ambient temperature and condition of the rails and rail-cars), and the plan may be updated to reflect such changes as needed by any of the methods discussed above and/or by real-time autonomous collection of locomotive/train conditions. This includes for example, changes in locomotive or train characteristics detected by monitoring equipment on or off board the locomotive(s) 42.

The track signal system determines the allowable speed of the train. There are many types of track signal systems and the operating rules associated with each of the signals. For example, some signals have a single light (on/off), some signals have a single lens with multiple colors, and some signals have multiple lights and colors. These signals can indicate the track is clear and the train may proceed at max allowable speed. They can also indicate a reduced speed or stop is required. This reduced speed may need to be achieved immediately, or at a certain location (e.g. prior to the next signal or crossing).

The signal status is communicated to the train and/or operator through various means. Some systems have circuits in the track and inductive pick-up coils on the locomotives. Other systems have wireless communications systems. Signal systems can also require the operator to visually inspect the signal and take the appropriate actions.

The signaling system may interface with the on-board signal system and adjust the locomotive speed according to the inputs and the appropriate operating rules. For signal systems that require the operator to visually inspect the signal status, the operator screen will present the appropriate signal options for the operator to enter based on the train's location. The type of signal systems and operating rules, as a function of location, may be stored in an onboard database 63.

Based on the specification data input into the exemplary embodiment of the present invention, an optimal plan which minimizes fuel use and/or emissions produced subject to speed limit constraints along the route with desired start and end times is computed to produce a trip profile 12. The profile contains the optimal speed and power (notch) settings the train is to follow, expressed as a function of distance and/or time, and such train operating limits, including but not limited to, the maximum notch power and brake settings, and speed limits as a function of location, and the expected fuel used and emissions generated. In an exemplary embodiment, the value for the notch setting is selected to obtain throttle change decisions about once every 10 to 30 seconds. Those skilled in the art will readily recognize that the throttle change decisions may occur at a longer or shorter duration, if needed and/or desired to follow an optimal speed profile. In a broader sense, it should be evident to ones skilled in the art the profiles provide power settings for the train, either at the train level, consist level and/or individual train level. Power comprises braking power, motive power, and airbrake power. In another preferred embodiment, instead of operating at the traditional discrete notch power settings, the exemplary embodiment of the present invention is able to select a continuous power setting determined as optimal for the profile selected. Thus, for example, if an optimal profile specifies a notch setting of 6.8, instead of operating at notch setting 7, the locomotive 42 can operate at 6.8. Allowing such intermediate power settings may bring additional efficiency benefits as described below.

The procedure used to compute the optimal profile can be any number of methods for computing a power sequence that drives the train 31 to minimize fuel and/or emissions subject to locomotive operating and schedule constraints, as summarized below. In some cases the required optimal profile may be close enough to one previously determined, owing to the similarity of the train configuration, route and environmental conditions. In these cases it may be sufficient to look up the driving trajectory within a database 63 and attempt to follow it. When no previously computed plan is suitable, methods to compute a new one include, but are not limited to, direct calculation of the optimal profile using differential equation models which approximate the train physics of motion. The setup involves selection of a quantitative objective function, commonly a weighted sum (integral) of model variables that correspond to rate of fuel consumption and emissions generation plus a term to penalize excessive throttle variation.

An optimal control formulation is set up to minimize the quantitative objective function subject to constraints including but not limited to, speed limits and minimum and maximum power (throttle) settings. Depending on planning objectives at any time, the problem may be setup flexibly to minimize fuel subject to constraints on emissions and speed limits, or to minimize emissions, subject to constraints on fuel use and arrival time. It is also possible to setup, for example, a goal to minimize the total travel time without constraints on total emissions or fuel use where such relaxation of constraints would be permitted or required for the mission.

Throughout the document exemplary equations and objective functions are presented for minimizing locomotive fuel consumption. These equations and functions are for illustration only as other equations and objective functions can be employed to optimize fuel consumption or to optimize other locomotive/train operating parameters.

Mathematically, the problem to be solved may be stated more precisely. The basic physics are expressed by:

$$\frac{dx}{dt} = v;\ x(0) = 0.0;\ x(T_f) = D$$

-continued $$\frac{dv}{dt} = T_e(u, v) - G_a(x) - R(v);\ v(0) = 0.0;\ v(T_f) = 0.0$$

Where x is the position of the train, v its velocity and t is time (in miles, miles per hour and minutes or hours as appropriate) and u is the notch (throttle) command input. Further, D denotes the distance to be traveled, $T_f$ the desired arrival time at distance D along the track, $T_e$ is the tractive effort produced by the locomotive consist, $G_a$ is the gravitational drag which depends on the train length, train makeup and terrain on which the train is located, R is the net speed dependent drag of the locomotive consist and train combination. The initial and final speeds can also be specified, but without loss of generality are taken to be zero here (train stopped at beginning and end). Finally, the model is readily modified to include other important dynamics such the lag between a change in throttle, u, and the resulting tractive effort or braking. Using this model, an optimal control formulation is set up to minimize the quantitative objective function subject to constraints including but not limited to, speed limits and minimum and maximum power (throttle) settings. Depending on planning objectives at any time, the problem may be setup flexibly to minimize fuel subject to constraints on emissions and speed limits, or to minimize emissions, subject to constraints on fuel use and arrival time.

It is also possible to setup, for example, a goal to minimize the total travel time without constraints on total emissions or fuel use where such relaxation of constraints would be permitted or required for the mission. All these performance measures can be expressed as a linear combination of any of the following:

$$\min_{u(t)} \int_0^{T_f} F(u(t))dt \text{ - Minimize total fuel consumption}$$

$$\min_{u(t)} T_f \text{ - Minimize Travel Time}$$

$$\min_{u_i} \sum_{i=2}^{n_d} (u_i - u_{i-1})^2 \text{ - Minimize notch jockeying}$$

(piecewise constant input)

$$\min_{u(t)} \int_0^{T_f} (du/dt)^2 dt \text{ - Minimize notch jockeying}$$

(continuous input)

Replace the fuel term F in (1) with a term corresponding to emissions production.

$$\min_{u(t)} \int_0^{T_f} E(u(t))dt \text{ - Minimize total emissions consumption}$$

For example for emissions In this equation E is the quantity of emissions in grams per horse power-hour (gm/hphr) for each of the notches (or power settings). In addition a minimization could be done based on a weighted total of fuel and emissions.

A commonly used and representative objective function is thus $$\min_{u(t)} \alpha_1 \int_0^{T_f} F(u(t))dt + \alpha_3 T_f + \alpha_2 \int_0^{T_f} (du/dt)^2 dt \quad \text{(OP)}$$

The coefficients of the linear combination depend on the importance (weight) given to each of the terms. Note that in equation (OP), u(t) is the optimizing variable that is the continuous notch position. If discrete notch is required, e.g. for older locomotives, the solution to equation (OP) is discretized, which may result in lower fuel savings. Finding a minimum time solution ($\alpha_1$ set to zero and $\alpha_2$ set to zero or a relatively small value) is used to find a lower bound for the achievable travel time ($T_f = T_{fmin}$). In this case, both u(t) and $T_f$ are optimizing variables. The preferred embodiment solves the equation (OP) for various values of $T_f$ with $T_f > T_{fmin}$ with $\alpha_3$ set to zero. In this latter case, $T_f$ is treated as a constraint.

For those familiar with solutions to such optimal problems, it may be necessary to adjoin constraints, e.g. the speed limits along the path:

$$0 \leqq v \leqq SL(x)$$

or when using minimum time as the objective, that an end point constraint must hold, e.g. total fuel consumed must be less than what is in the tank, e.g. via:

$$0 < \int_0^{T_f} F(u(t))dt \leq W_F$$

where $W_F$ is the fuel remaining in the tank at $T_f$. Those skilled in the art will readily recognize that equation (OP) can be in other forms as well and that what is presented above is an exemplary equation for use in the exemplary embodiment of the present invention.

Reference to emissions in the context of the exemplary embodiment of the present invention may be directed towards cumulative emissions produced from a variety of forms. For example, an emission requirement may set a maximum value of an oxide of nitrogen ($NO_x$) emissions, hydrocarbon emissions (HC), carbon oxide ($CO_x$) emissions, and/or particulate matter (PM) emissions. Other emission limits may include a maximum value of an electromagnetic emission, such as a limit on radio frequency (RF) power output, measured in watts, for respective frequencies emitted by the locomotive. Yet another form of emission is the noise produced by the locomotive, typically measured in decibels (dB). An emission requirement may be variable based on a time of day, a time of year, and/or atmospheric conditions such as weather or pollutant level in the atmosphere. It is known that emissions regulations may vary geographically across a railroad system. For instance, an operating area such as a city or state may have specified emissions objectives, and an adjacent operating area may have different emission objectives, for example a lower amount of allowed emissions or a higher fee charged for a given level of emissions. Accordingly, an emission profile for a certain geographic area may be tailored to include maximum emission values for each of the regulated emission including in the profile to meet a predetermined emission objectives required for that area. Typically for a locomotive, these emission parameters are determined by the power (Notch), ambient conditions, engine control method etc.

By design, every locomotive must be compliant to EPA standards for brake-specific emissions, and thus when emissions are optimized in the exemplary embodiment of the present invention this would be mission total emissions on which there is no specification today. At all times, operations would be compliant with federal EPA mandates. If a key objective during a trip mission is to reduce emissions, the optimal control formulation, equation (OP), would be amended to consider this trip objective. A key flexibility in the optimization setup is that any or all of the trip objectives can vary by geographic region or mission. For example, for a high priority train, minimum time may be the only objective on one route because it is high priority traffic. In another example emission output could vary from state to state along the planned train route.

To solve the resulting optimization problem, in an exemplary embodiment the present invention transcribes a dynamic optimal control problem in the time domain to an equivalent static mathematical programming problem with N decision variables, where the number 'N' depends on the frequency at which throttle and braking adjustments are made and the duration of the trip. For typical problems, this N can be in the thousands. For example in an exemplary embodiment, suppose a train is traveling a 172-mile stretch of track in the southwest United States. Utilizing the exemplary embodiment of the present invention, an exemplary 7.6% saving in fuel used may be realized when comparing a trip determined and followed using the exemplary embodiment of the present invention versus an actual driver throttle/speed history where the trip was determined by an operator. The improved savings is realized because the optimization realized by using the exemplary embodiment of the present invention produces a driving strategy with both less drag loss and little or no braking loss compared to the trip plan of the operator.

Figure 2:
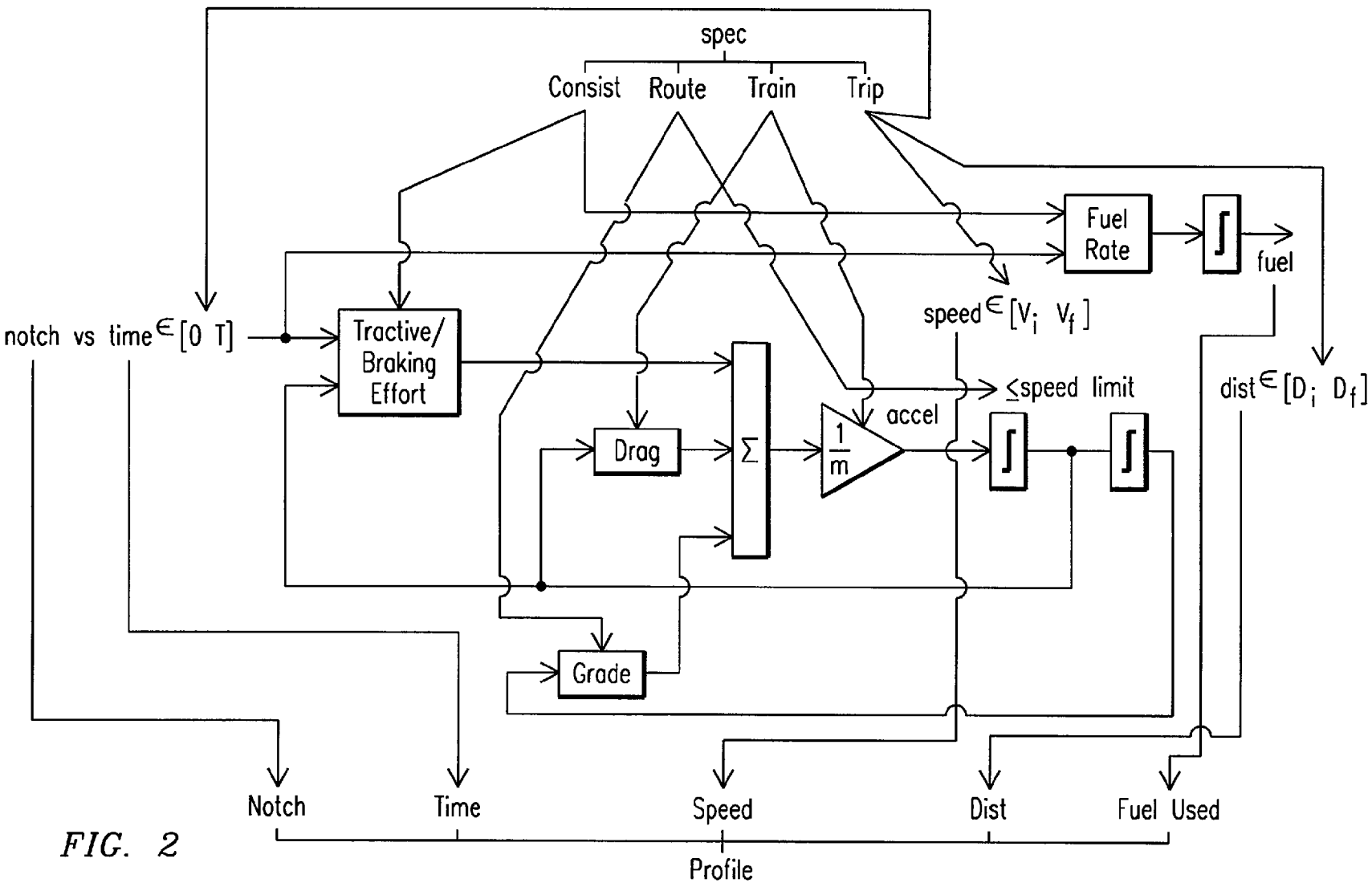
FIG. 2 depicts a simplified model of the train that may be employed.

To make the optimization described above computationally tractable, a simplified model of the train may be employed, such as illustrated in FIG. 2 and the equations discussed above. A key refinement to the optimal profile is produced by driving a more detailed model with the optimal power sequence generated, to test if other thermal, electrical and mechanical constraints are violated, leading to a modified profile with speed versus distance that is closest to a run that can be achieved without harming locomotive or train equipment, i.e. satisfying additional implied constraints such thermal and electrical limits on the locomotive and inter-car forces in the train.

Referring back to FIG. 1, once the trip is started 12, power commands are generated 14 to put the plan in motion. Depending on the operational set-up of the exemplary embodiment of the present invention, one command is for the locomotive to follow the optimized power command 16 so as to achieve the optimal speed. The exemplary embodiment of the present invention obtains actual speed and power information from the locomotive consist of the train 18. Owing to the inevitable approximations in the models used for the optimization, a closed-loop calculation of corrections to optimized power is obtained to track the desired optimal speed. Such corrections of train operating limits can be made automatically or by the operator, who always has ultimate control of the train.

In some cases, the model used in the optimization may differ significantly from the actual train. This can occur for many reasons, including but not limited to, extra cargo pick-ups or setouts, locomotives that fail in route, and errors in the initial database 63 or data entry by the operator. For these reasons a monitoring system is in place that uses real-time train data to estimate locomotive and/or train parameters in real time 20. The estimated parameters are then compared to the assumed parameters used when the trip was initially created 22. Based on any differences in the assumed and estimated values, the trip may be re-planned 24, should large enough savings accrue from a new plan.

Other reasons a trip may be re-planned include directives from a remote location, such as dispatch and/or the operator requesting a change in objectives to be consistent with more global movement planning objectives. More global movement planning objectives may include, but are not limited to, other train schedules, allowing exhaust to dissipate from a tunnel, maintenance operations, etc. Another reason may be due to an onboard failure of a component. Strategies for re-planning may be grouped into incremental and major adjustments depending on the severity of the disruption, as discussed in more detail below. In general, a "new" plan must be derived from a solution to the optimization problem equation (OP) described above, but frequently faster approximate solutions can be found, as described herein.

Figure 4:
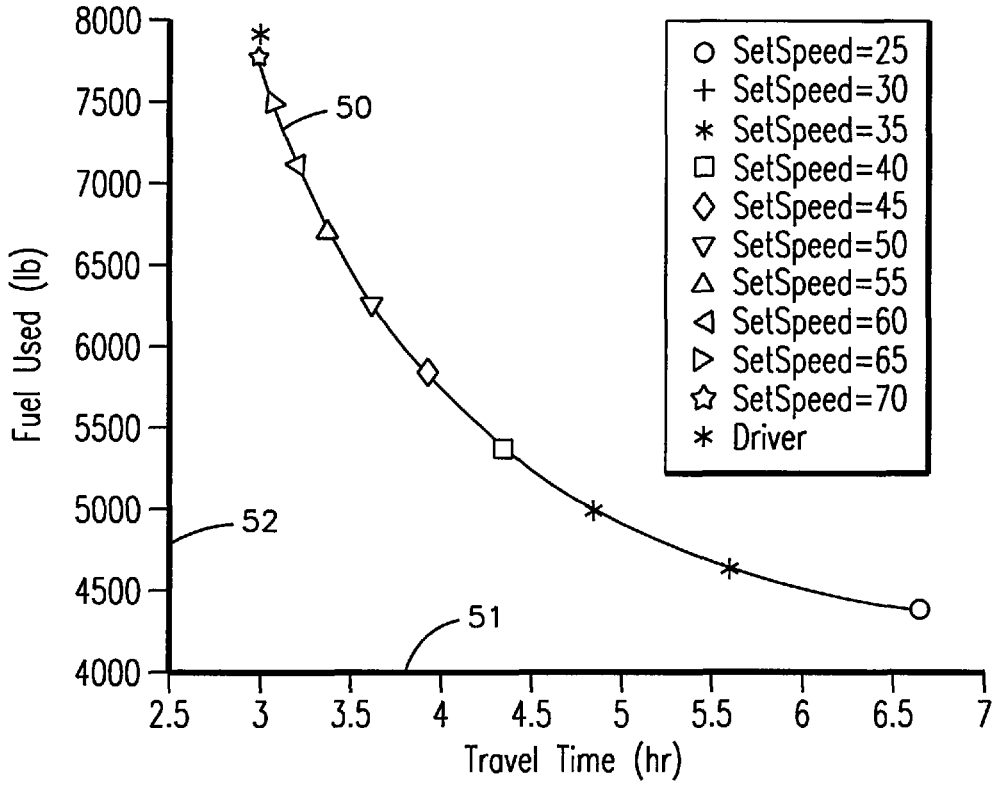
FIG. 4 depicts an exemplary embodiment of a fuel-use/travel time curve.

In operation, the locomotive 42 will continuously monitor system efficiency and continuously update the trip plan based on the actual efficiency measured, whenever such an update would improve trip performance. Re-planning computations may be carried out entirely within the locomotive(s) or fully or partially moved to a remote location, such as dispatch or wayside processing facilities where wireless technology is used to communicate the plans to the locomotive 42. The exemplary embodiment of the present invention may also generate efficiency trends that can be used to develop locomotive fleet data regarding efficiency transfer functions. The fleet-wide data may be used when determining the initial trip plan, and may be used for network-wide optimization tradeoff when considering locations of a plurality of trains. For example, the travel-time fuel use tradeoff curve as illustrated in FIG. 4 reflects a capability of a train on a particular route at a current time, updated from ensemble averages collected for many similar trains on the same route. Thus, a central dispatch facility collecting curves like FIG. 4 from many locomotives could use that information to better coordinate overall train movements to achieve a system-wide advantage in fuel use or throughput.

Many events in daily operations can lead to a need to generate or modify a currently executing plan, where it desired to keep the same trip objectives, for when a train is not on schedule for planned meet or pass with another train and it needs to make up time. Using the actual speed, power and location of the locomotive, a comparison is made between a planned arrival time and the currently estimated (predicted) arrival time 25. Based on a difference in the times, as well as the difference in parameters (detected or changed by dispatch or the operator), the plan is adjusted 26. This adjustment may be made automatically following a railroad company's desire for how such departures from plan should be handled or manually propose alternatives for the on-board operator and dispatcher to jointly decide the best way to get back on plan. Whenever a plan is updated but where the original objectives, such as but not limited to arrival time remain the same, additional changes may be factored in concurrently, e.g. new future speed limit changes, which could affect the feasibility of ever recovering the original plan. In such instances if the original trip plan cannot be maintained, or in other words the train is unable to meet the original trip plan objectives, as discussed herein other trip plan(s) may be presented to the operator and/or remote facility, or dispatch.

A re-plan may also be made when it is desired to change the original objectives. Such re-planning can be done at either fixed preplanned times, manually at the discretion of the operator or dispatcher, or autonomously when predefined limits, such a train operating limits, are exceeded. For example, if the current plan execution is running late by more than a specified threshold, such as thirty minutes, the exemplary embodiment of the present invention can re-plan the trip to accommodate the delay at expense of increased fuel as described above or to alert the operator and dispatcher how much of the time can be made up at all (i.e. what minimum time to go or the maximum fuel that can be saved within a time constraint). Other triggers for re-plan can also be envisioned based on fuel consumed or the health of the power consist, including but not limited time of arrival, loss of horsepower due to equipment failure and/or equipment temporary malfunction (such as operating too hot or too cold), and/or detection of gross setup errors, such in the assumed train load. That is, if the change reflects impairment in the locomotive performance for the current trip, these may be factored into the models and/or equations used in the optimization.

Changes in plan objectives can also arise from a need to coordinate events where the plan for one train compromises the ability of another train to meet objectives and arbitration at a different level, e.g. the dispatch office is required. For example, the coordination of meets and passes may be further optimized through train-to-train communications. Thus, as an example, if a train knows that it is behind in reaching a location for a meet and/or pass, communications from the other train can notify the late train (and/or dispatch). The operator can then enter information pertaining to being late into the exemplary embodiment of the present invention wherein the exemplary embodiment will recalculate the train's trip plan. The exemplary embodiment of the present invention can also be used at a high level, or network-level, to allow a dispatch to determine which train should slow down or speed up should a scheduled meet and/or pass time constraint may not be met. As discussed herein, this is accomplished by trains transmitting data to the dispatch to prioritize how each train should change its planning objective. A choice could depend either from schedule or fuel saving benefits, depending on the situation.

For any of the manually or automatically initiated re-plans, exemplary embodiments of the present invention may present more than one trip plan to the operator. In an exemplary embodiment the present invention will present different profiles to the operator, allowing the operator to select the arrival time and understand the corresponding fuel and/or emission impact. Such information can also be provided to the dispatch for similar consideration, either as a simple list of alternatives or as a plurality of tradeoff curves such as illustrated in FIG. 4.

The exemplary embodiment of the present invention has the ability of learning and adapting to key changes in the train and power consist which can be incorporated either in the current plan and/or for future plans. For example, one of the triggers discussed above is loss of horsepower. When building up horsepower over time, either after a loss of horsepower or when beginning a trip, transition logic is utilized to determine when desired horsepower is achieved. This information can be saved in the locomotive database 61 for use in optimizing either future trips or the current trip should loss of horsepower occur again.

Figure 3:
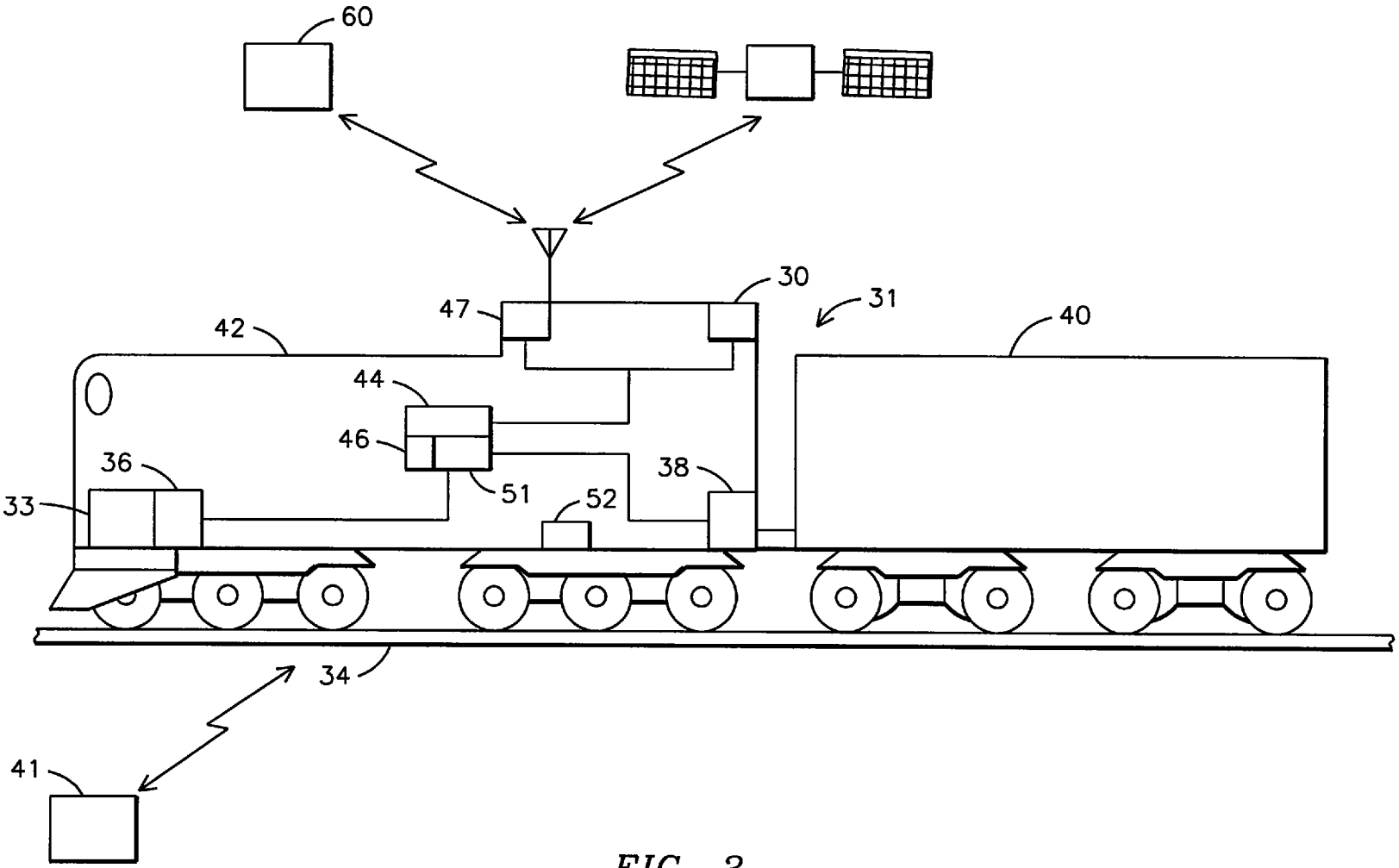
FIG. 3 depicts an exemplary embodiment of elements of the present invention.

FIG. 3 depicts an exemplary embodiment of elements of that may part of an exemplary system. A locator element 30 to determine a location of the train 31 is provided. The locator element 30 can be a GPS sensor, or a system of sensors, that determine a location of the train 31. Examples of such other systems may include, but are not limited to, wayside devices, such as radio frequency automatic equipment identification (RF AEI) Tags, dispatch, and/or video determination. Another system may include the tachometer(s) aboard a locomotive and distance calculations from a reference point. As discussed previously, a wireless communication system 47 may also be provided to allow for communications between trains and/or with a remote location, such as dispatch. Information about travel locations may also be transferred from other trains.

A track characterization element 33 to provide information about a track, principally grade and elevation and curvature information, is also provided. The track characterization element 33 may include an on-board track integrity database 36. Sensors 38 are used to measure a tractive effort 40 being hauled by the locomotive consist 42, throttle setting of the locomotive consist 42, locomotive consist 42 configuration information, speed of the locomotive consist 42, individual locomotive configuration, individual locomotive capability, etc. In an exemplary embodiment the locomotive consist 42 configuration information may be loaded without the use of a sensor 38, but is input by other approaches as discussed above. Furthermore, the health of the locomotives in the consist may also be considered. For example, if one locomotive in the consist is unable to operate above power notch level 5, this information is used when optimizing the trip plan.

Information from the locator element may also be used to determine an appropriate arrival time of the train 31. For example, if there is a train 31 moving along a track 34 towards a destination and no train is following behind it, and the train has no fixed arrival deadline to adhere to, the locator element, including but not limited to radio frequency automatic equipment identification (RF AEI) Tags, dispatch, and/or video determination, may be used to gage the exact location of the train 31. Furthermore, inputs from these signaling systems may be used to adjust the train speed. Using the on-board track database, discussed below, and the locator element, such as GPS, the exemplary embodiment of the present invention can adjust the operator interface to reflect the signaling system state at the given locomotive location. In a situation where signal states would indicate restrictive speeds ahead, the planner may elect to slow the train to conserve fuel consumption.

Information from the locator element 30 may also be used to change planning objectives as a function of distance to destination. For example, owing to inevitable uncertainties about congestion along the route, "faster" time objectives on the early part of a route may be employed as hedge against delays that statistically occur later. If it happens on a particular trip that delays do not occur, the objectives on a latter part of the journey can be modified to exploit the built-in slack time that was banked earlier, and thereby recover some fuel efficiency. A similar strategy could be invoked with respect to emissions restrictive objectives, e.g. approaching an urban area.

As an example of the hedging strategy, if a trip is planned from New York to Chicago, the system may have an option to operate the train slower at either the beginning of the trip or at the middle of the trip or at the end of the trip. The exemplary embodiment of the present invention would optimize the trip plan to allow for slower operation at the end of the trip since unknown constraints, such as but not limited to weather conditions, track maintenance, etc., may develop and become known during the trip. As another consideration, if traditionally congested areas are known, the plan is developed with an option to have more flexibility around these traditionally congested regions. Therefore, the exemplary embodiment of the present invention may also consider weighting/penalty as a function of time/distance into the future and/or based on known/past experience. Those skilled in the art will readily recognize that such planning and re-planning to take into consideration weather conditions, track conditions, other trains on the track, etc., may be taking into consideration at any time during the trip wherein the trip plan is adjust accordingly.

FIG. 3 further discloses other elements that may be part of the exemplary embodiment of the present invention. A processor 44 is provided that is operable to receive information from the locator element 30, track characterizing element 33, and sensors 38. An algorithm 46 operates within the processor 44. The algorithm 46 is used to compute an optimized trip plan based on parameters involving the locomotive 42, train 31, track 34, and objectives of the mission as described above. In an exemplary embodiment, the trip plan is established based on models for train behavior as the train 31 moves along the track 34 as a solution of non-linear differential equations derived from physics with simplifying assumptions that are provided in the algorithm. The algorithm 46 has access to the information from the locator element 30, track characterizing element 33 and/or sensors 38 to create a trip plan minimizing fuel consumption of a locomotive consist 42, minimizing emissions of a locomotive consist 42, establishing a desired trip time, and/or ensuring proper crew operating time aboard the locomotive consist 42. In an exemplary embodiment, a driver, or controller element, 51 is also provided. As discussed herein the controller element 51 is used for controlling the train as it follows the trip plan. In an exemplary embodiment discussed further herein, the controller element 51 makes train operating decisions autonomously. In another exemplary embodiment the operator may be involved with directing the train to follow the trip plan.

A requirement of the exemplary embodiment of the present invention is the ability to initially create and quickly modify on the fly any plan that is being executed. This includes creating the initial plan when a long distance is involved, owing to the complexity of the plan optimization algorithm. When a total length of a trip profile exceeds a given distance, an algorithm 46 may be used to segment the mission wherein the mission may be divided by waypoints. Though only a single algorithm 46 is discussed, those skilled in the art will readily recognize that more than one algorithm may be used where the algorithms may be connected together. The waypoint may include natural locations where the train 31 stops, such as, but not limited to, sidings where a meet with opposing traffic, or pass with a train behind the current train is scheduled to occur on single-track rail, or at yard sidings or industry where cars are to be picked up and set out, and locations of planned work. At such waypoints, the train 31 may be required to be at the location at a scheduled time and be stopped or moving with speed in a specified range. The time duration from arrival to departure at waypoints is called dwell time.

In an exemplary embodiment, the present invention is able to break down a longer trip into smaller segments in a special systematic way. Each segment can be somewhat arbitrary in length, but is typically picked at a natural location such as a stop or significant speed restriction, or at key mileposts that define junctions with other routes. Given a partition, or segment, selected in this way, a driving profile is created for each segment of track as a function of travel time taken as an independent variable, such as shown in FIG. 4. The fuel used/travel-time tradeoff associated with each segment can be computed prior to the train 31 reaching that segment of track. A total trip plan can be created from the driving profiles created for each segment. The exemplary embodiment of the invention distributes travel time amongst all the segments of the trip in an optimal way so that the total trip time required is satisfied and total fuel consumed over all the segments is as small as possible. An exemplary 3 segment trip is disclosed in FIG. 6 and discussed below. Those skilled in the art will recognize however, through segments are discussed, the trip plan may comprise a single segment representing the complete trip.

FIG. 4 depicts an exemplary embodiment of a fuel-use/travel time curve. As mentioned previously, such a curve 50 is created when calculating an optimal trip profile for various travel times for each segment. That is, for a given travel time 51, fuel used 52 is the result of a detailed driving profile computed as described above. Once travel times for each segment are allocated, a power/speed plan is determined for each segment from the previously computed solutions. If there are any waypoint constraints on speed between the segments, such as, but not limited to, a change in a speed limit, they are matched up during creation of the optimal trip profile. If speed restrictions change in only a single segment, the fuel use/travel-time curve 50 has to be re-computed for only the segment changed. This reduces time for having to recalculate more parts, or segments, of the trip. If the locomotive consist or train changes significantly along the route, e.g. from loss of a locomotive or pickup or set-out of cars, then driving profiles for all subsequent segments must be recomputed creating new instances of the curve 50. These new curves 50 would then be used along with new schedule objectives to plan the remaining trip.

Once a trip plan is created as discussed above, a trajectory of speed and power versus distance is used to reach a destination with minimum fuel and/or emissions at the required trip time. There are several ways in which to execute the trip plan. As provided below in more detail, in an exemplary embodiment, when in a coaching mode information is displayed to the operator for the operator to follow to achieve the required power and speed determined according to the optimal trip plan. In this mode, the operating information is suggested operating conditions that the operator should use. In another exemplary embodiment, acceleration and maintaining a constant speed are performed. However, when the train 31 must be slowed, the operator is responsible for applying a braking system 52. In another exemplary embodiment of the present invention commands for powering and braking are provided as required to follow the desired speed-distance path.

Feedback control strategies are used to provide corrections to the power control sequence in the profile to correct for such events as, but not limited to, train load variations caused by fluctuating head winds and/or tail winds. Another such error may be caused by an error in train parameters, such as, but not limited to, train mass and/or drag, when compared to assumptions in the optimized trip plan. A third type of error may occur with information contained in the track database 36. Another possible error may involve un-modeled performance differences due to the locomotive engine, traction motor thermal deration and/or other factors. Feedback control strategies compare the actual speed as a function of position to the speed in the desired optimal profile. Based on this difference, a correction to the optimal power profile is added to drive the actual velocity toward the optimal profile. To assure stable regulation, a compensation algorithm may be provided which filters the feedback speeds into power corrections to assure closed-performance stability is assured. Compensation may include standard dynamic compensation as used by those skilled in the art of control system design to meet performance objectives.

Exemplary embodiments of the present invention allow the simplest and therefore fastest means to accommodate changes in trip objectives, which is the rule, rather than the exception in railroad operations. In an exemplary embodiment to determine the fuel-optimal trip from point A to point B where there are stops along the way, and for updating the trip for the remainder of the trip once the trip has begun, a sub-optimal decomposition method is usable for finding an optimal trip profile. Using modeling methods the computation method can find the trip plan with specified travel time and initial and final speeds, so as to satisfy all the speed limits and locomotive capability constraints when there are stops. Though the following discussion is directed towards optimizing fuel use, it can also be applied to optimize other factors, such as, but not limited to, emissions, schedule, crew comfort, and load impact. The method may be used at the outset in developing a trip plan, and more importantly to adapting to changes in objectives after initiating a trip.

Figure 5:
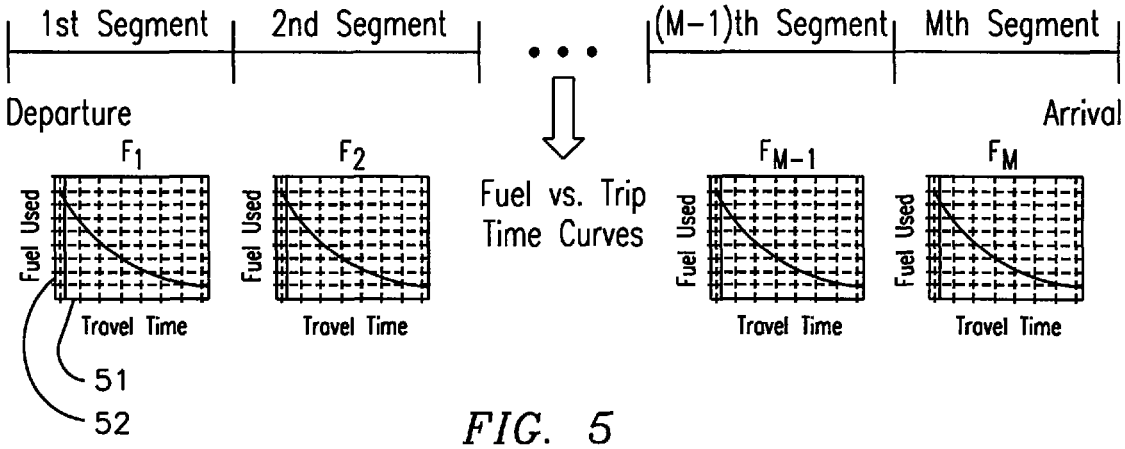
FIG. 5 depicts an exemplary embodiment of segmentation decomposition for trip planning.
Figure 6:
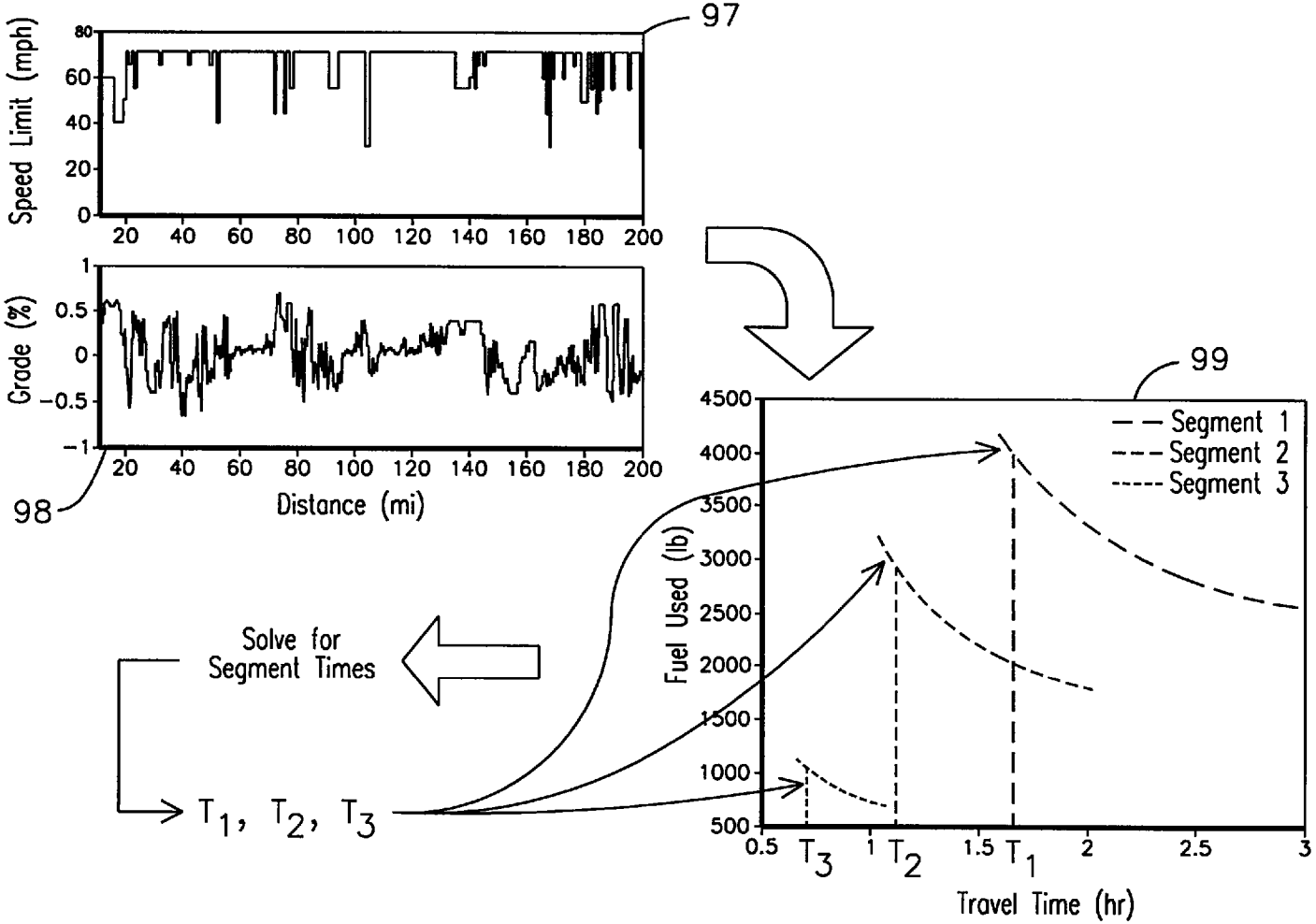
FIG. 6 depicts an exemplary embodiment of a segmentation example.

As discussed herein, exemplary embodiments of the present invention may employ a setup as illustrated in the exemplary flow chart depicted in FIG. 5, and as an exemplary 3 segment example depicted in detail in FIG. 6. As illustrated, the trip may be broken into two or more segments, T1, T2, and T3. Though as discussed herein, it is possible to consider the trip as a single segment. As discussed herein, the segment boundaries may not result in equal segments. Instead the segments use natural or mission specific boundaries. Optimal trip plans are pre-computed for each segment. If fuel use versus trip time is the trip object to be met, fuel versus trip time curves are built for each segment. As discussed herein, the curves may be based on other factors, wherein the factors are objectives to be met with a trip plan. When trip time is the parameter being determined, trip time for each segment is computed while satisfying the overall trip time constraints. FIG. 6 illustrates speed limits for an exemplary 3 segment 200 mile trip 97. Further illustrated are grade changes over the 200 mile trip 98. A combined chart 99 illustrating curves for each segment of the trip of fuel used over the travel time is also shown.

Using the optimal control setup described previously, the present computation method can find the trip plan with specified travel time and initial and final speeds, so as to satisfy all the speed limits and locomotive capability constraints when there are stops. Though the following detailed discussion is directed towards optimizing fuel use, it can also be applied to optimize other factors as discussed herein, such as, but not limited to, emissions. A key flexibility is to accommodate desired dwell time at stops and to consider constraints on earliest arrival and departure at a location as may be required, for example, in single-track operations where the time to be in or get by a siding is critical.

Exemplary embodiments of the present invention find a fuel-optimal trip from distance $D_0$ to $D_M$, traveled in time T, with M−1 intermediate stops at $D_1, \ldots, D_{M-1}$, and with the arrival and departure times at these stops constrained by $$t_{min}(i) \leqq t_{arr}(D_i) \leqq t_{max}(i) - \Delta t_i$$

$$t_{arr}(D_i) + \Delta t_i \leqq t_{dep}(D_i) \leqq t_{max}(i) i = 1, \ldots, M-1$$

where $t_{arr}(D_i)$, $t_{dep}(D_i)$ and $\Delta t_i$ are the arrival, departure, and minimum stop time at the $i^{th}$ stop, respectively. Assuming that fuel-optimality implies minimizing stop time, therefore $t_{dep}(D_i) = t_{arr}(D_i) + \Delta t_i$ which eliminates the second inequality above. Suppose for each i=1, . . . , M, the fuel-optimal trip from $D_{i-1}$ to $D_i$ for travel time t, $T_{min}(i) \leqq t \leqq T_{max}(i)$, is known. Let $F_i(t)$ be the fuel-use corresponding to this trip. If the travel time from $D_{j-1}$ to $D_j$ is denoted $T_j$, then the arrival time at $D_i$ is given by $$t_{arr}(D_i) = \sum_{j=1}^{i} (T_j + \Delta t_{j-1})$$

where $\Delta t_0$ is defined to be zero. The fuel-optimal trip from $D_0$ to $D_M$ for travel time T is then obtained by finding $T_i$, i=1, . . . , M, which minimize $$\sum_{i=1}^{M} F_i(T_i) T_{min}(i) \le T_i \le T_{max}(i)$$

subject to $$t_{min}(i) \le \sum_{j=1}^{i} (T_j + \Delta t_{j-1}) \le t_{max}(i) - \Delta t_i$$

$$i = 1, \ldots, M-1$$

$$\sum_{j=1}^{M} (T_j + \Delta t_{j-1}) = T$$

Once a trip is underway, the issue is re-determining the fuel-optimal solution for the remainder of a trip (originally from $D_0$ to $D_M$ in time T) as the trip is traveled, but where disturbances preclude following the fuel-optimal solution. Let the current distance and speed be x and v, respectively, where $D_{i-1}<x\leqq D_i$. Also, let the current time since the beginning of the trip be $t_{act}$. Then the fuel-optimal solution for the remainder of the trip from x to $D_M$, which retains the original arrival time at $D_M$, is obtained by finding $\tilde{T}_i$, $T_j$, j=i+1, . . . M, which minimize $$\tilde{F}_i(\tilde{T}_i, x, v) + \sum_{j=i+1}^{M} F_j(T_j)$$

subject to $$t_{min}(i) \le t_{act} + \tilde{T}_i \le t_{max}(i) - \Delta t_i$$

$$t_{min}(k) \le t_{act} + \tilde{T}_i + \sum_{j=i+1}^{k} (T_j + \Delta t_{j-1}) \le t_{max}(k) - \Delta t_k$$

$$k = i+1, \ldots, M-1$$

$$t_{act} + \tilde{T}_i + \sum_{j=i+1}^{M} (T_j + \Delta t_{j-1}) = T$$

Here, $\tilde{F}_i(t,x,v)$ is the fuel-used of the optimal trip from x to $D_i$, traveled in time t, with initial speed at x of v.

As discussed above, an exemplary way to enable more efficient re-planning is to construct the optimal solution for a stop-to-stop trip from partitioned segments. For the trip from $D_{1-1}$ to $D_i$, with travel time $T_i$, choose a set of intermediate points $D_{ij}$, j=1, . . . , $N_{i-1}$. Let $D_{i0}=D_{i-1}$ and $D_{iN_i}=D_i$. Then express the fuel-use for the optimal trip from $D_{i-1}$ to $D_i$ as $$F_i(t) = \sum_{j=1}^{N_i} f_{ij}(t_{ij} - t_{i,j-1}, v_{i,j-1}, v_{ij})$$

where $f_{ij}(t, v_{i,j-1}, v_{ij})$ is the fuel-use for the optimal trip from $D_{i,j-1}$ to $D_{ij}$, traveled in time t, with initial and final speeds of $v_{i,j-1}$ and $v_{ij}$. Furthermore, $t_{ij}$ is the time in the optimal trip corresponding to distance $D_{ij}$. By definition, $t_{iN_i}-t_{i0}=T_i$. Since the train is stopped at $D_{i0}$ and $D_{iN_i}$, $v_{i0}=v_{iN_i}=0$.

The above expression enables the function $F_i(t)$ to be alternatively determined by first determining the functions $f_{ij}(\bullet)$, $1\leqq j\leqq N_i$, then finding $\tau_{ij}$, $1\leqq j\leqq N_i$ and $v_{ij}$, $1\leqq j<N_i$, which minimize $$F_i(t) = \sum_{j=1}^{N_i} f_{ij}(\tau_{ij}, v_{i,j-1}, v_{ij})$$

subject to $$\sum_{j=1}^{N_i} \tau_{ij} = T_i$$

$$v_{min}(i, j) \le v_{ij} \le v_{max}(i, j)$$

$$j = 1, \ldots, N_i - 1$$

$$v_{i0} = v_{iN_i} = 0$$

By choosing $D_{ij}$ (e.g., at speed restrictions or meeting points), $v_{max}(i,j)-v_{min}(i,j)$ can be minimized, thus minimizing the domain over which $f_{ij}(\ )$ needs to be known.

Based on the partitioning above, a simpler suboptimal re-planning approach than that described above is to restrict re-planning to times when the train is at distance points $D_{ij}$, $1\leqq i\leqq M$, $1\leqq j\leqq N_i$. At point $D_{ij}$, the new optimal trip from $D_{ij}$ to $D_M$ can be determined by finding $\tau_{ik}$, $j<k\leqq N_i$, $v_{ik}$, $j<k<N_i$, and $\tau_{mn}$, $i<m\leqq M$, $1\leqq n\leqq N_m$, $v_{mn}$, $i<m\leqq M$, $1\leqq n<N_m$, which minimize $$\sum_{k=j+1}^{N_i} f_{ik}(\tau_{ik}, v_{i,k-1}, v_{ik}) + \sum_{m=i+1}^{M} \sum_{n=1}^{N_m} f_{mn}(\tau_{mn}, v_{m,n-1}, n_{mn})$$

subject to $$t_{min}(i) \le t_{act} + \sum_{k=j+1}^{N_i} \tau_{ik} \le t_{max}(i) - \Delta t_i$$

$$t_{min}(n) \le t_{act} + \sum_{k=j+1}^{N_i} \tau_{ik} + \sum_{m=i+1}^{n} (T_m + \Delta t_{m-1}) \le t_{max}(n) - \Delta t_n$$

$$n = i+1, \ldots, M-1$$

$$t_{act} + \sum_{k=j+1}^{N_i} \tau_{ik} + \sum_{m=i+1}^{M} (T_m + \Delta t_{m-1}) = T$$

where $$T_m = \sum_{n=1}^{N_m} \tau_{mn}$$

A further simplification is obtained by waiting on the re-computation of $T_m$, $i<m\leqq M$, until distance point $D_i$ is reached. In this way, at points $D_{ij}$ between $D_{i-1}$ and $D_i$, the minimization above needs only be performed over $\tau_{ik}$, $j<k\leqq N_i$, $v_{ik}$, $j<k<N_i$. $T_i$ is increased as needed to accommodate any longer actual travel time from $D_{i-11}$ to $D_{ij}$ than planned. This increase is later compensated, if possible, by the re-computation of $T_m$, $i<m\leqq M$, at distance point $D_i$.

With respect to the closed-loop configuration disclosed above, the total input energy required to move a train 31 from point A to point B consists of the sum of four components, specifically difference in kinetic energy between points A and B; difference in potential energy between points A and B; energy loss due to friction and other drag losses; and energy dissipated by the application of brakes. Assuming the start and end speeds to be equal (e.g., stationary), the first component is zero. Furthermore, the second component is independent of driving strategy. Thus, it suffices to minimize the sum of the last two components.

Following a constant speed profile minimizes drag loss. Following a constant speed profile also minimizes total energy input when braking is not needed to maintain constant speed. However, if braking is required to maintain constant speed, applying braking just to maintain constant speed will most likely increase total required energy because of the need to replenish the energy dissipated by the brakes. A possibility exists that some braking may actually reduce total energy usage if the additional brake loss is more than offset by the resultant decrease in drag loss caused by braking, by reducing speed variation.

After completing a re-plan from the collection of events described above, the new optimal notch/speed plan can be followed using the closed loop control described herein. However, in some situations there may not be enough time to carry out the segment decomposed planning described above, and particularly when there are critical speed restrictions that must be respected, an alternative is needed. Exemplary embodiments of the present invention accomplish this with an algorithm referred to as "smart cruise control". The smart cruise control algorithm is an efficient way to generate, on the fly, an energy-efficient (hence fuel-efficient) sub-optimal prescription for driving the train 31 over a known terrain. This algorithm assumes knowledge of the position of the train 31 along the track 34 at all times, as well as knowledge of the grade and curvature of the track versus position. The method relies on a point-mass model for the motion of the train 31, whose parameters may be adaptively estimated from online measurements of train motion as described earlier.

The smart cruise control algorithm has three principal components, specifically a modified speed limit profile that serves as an energy-efficient guide around speed limit reductions; an ideal throttle or dynamic brake setting profile that attempts to balance between minimizing speed variation and braking; and a mechanism for combining the latter two components to produce a notch command, employing a speed feedback loop to compensate for mismatches of modeled parameters when compared to reality parameters. Smart cruise control can accommodate strategies in exemplary embodiments of the present invention that do no active braking (i.e. the driver is signaled and assumed to provide the requisite braking) or a variant that does active braking.

With respect to the cruise control algorithm that does not control dynamic braking, the three exemplary components are a modified speed limit profile that serves as an energy-efficient guide around speed limit reductions, a notification signal directed to notify the operator when braking should be applied, an ideal throttle profile that attempts to balance between minimizing speed variations and notifying the operator to apply braking, a mechanism employing a feedback loop to compensate for mismatches of model parameters to reality parameters.

Also included in exemplary embodiments of the present invention is an approach to identify key parameter values of the train 31. For example, with respect to estimating train mass, a Kalman filter and a recursive least-squares approach may be utilized to detect errors that may develop over time.

Figure 7:
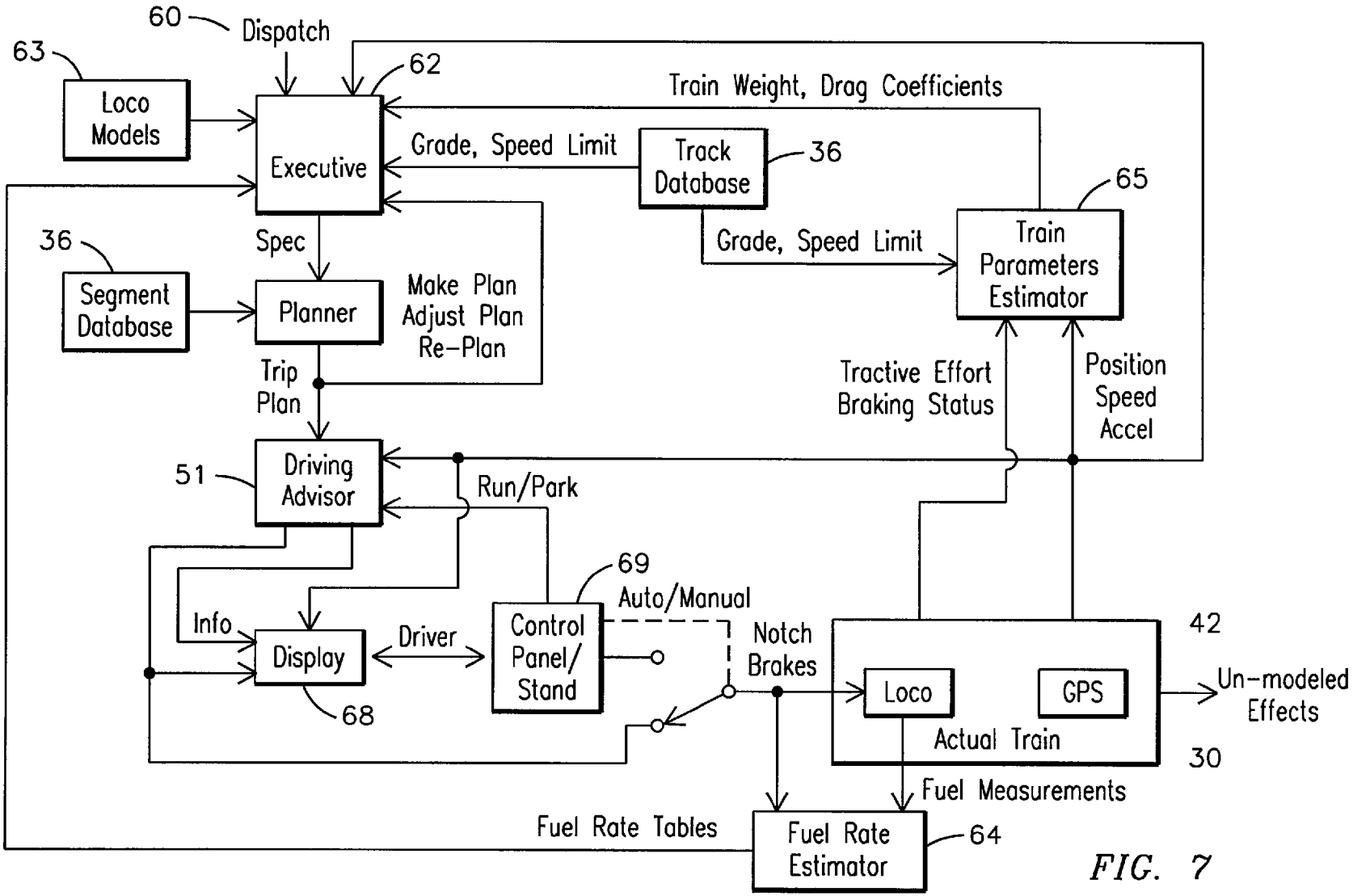
FIG. 7 depicts an exemplary flow chart of the present invention.

FIG. 7 depicts an exemplary flow chart of the present invention. As discussed previously, a remote facility, such as a dispatch 60 (as disclosed in FIG. 3) can provide information. As illustrated, such information is provided to an executive control element 62. Also supplied to the executive control element 62 is locomotive modeling information database 63, information from a track database 36 such as, but not limited to, track grade information and speed limit information, estimated train parameters such as, but not limited to, train weight and drag coefficients, and fuel rate tables from a fuel rate estimator 64. The executive control element 62 supplies information to the planner 12, which is disclosed in more detail in FIG. 1. Once a trip plan has been calculated, the plan is supplied to a driving advisor, driver or controller element 51. The trip plan is also supplied to the executive control element 62 so that it can compare the trip when other new data is provided.

As discussed above, the driving advisor 51 can automatically set a notch power, either a pre-established notch setting or an optimum continuous notch power. In addition to supplying a speed command to the locomotive 31, a display 68 is provided so that the operator can view what the planner has recommended. The operator also has access to a control panel 69. Through the control panel 69 the operator can decide whether to apply the notch power recommended. Towards this end, the operator may limit a targeted or recommended power. That is, at any time the operator always has final authority over what power setting the locomotive consist will operate at. This includes deciding whether to apply braking if the trip plan recommends slowing the train 31. For example, if operating in dark territory, or where information from wayside equipment cannot electronically transmit information to a train and instead the operator views visual signals from the wayside equipment, the operator inputs commands based on information contained in track database and visual signals from the wayside equipment. Based on how the train 31 is functioning, information regarding fuel measurement is supplied to the fuel rate estimator 64. Since direct measurement of fuel flows is not typically available in a locomotive consist, all information on fuel consumed so far within a trip and projections into the future following optimal plans is carried out using calibrated physics models such as those used in developing the optimal plans. For example, such predictions may include but are not limited to, the use of measured gross horse-power and known fuel characteristics to derive the cumulative fuel used.

The train 31 also has a locator device 30 such as a GPS sensor, as discussed above. Information is supplied to the train parameters estimator 65. Such information may include, but is not limited to, GPS sensor data, tractive/braking effort data, braking status data, speed and any changes in speed data. With information regarding grade and speed limit information, train weight and drag coefficients information is supplied to the executive control element 62.

Exemplary embodiments of the present invention may also allow for the use of continuously variable power throughout the optimization planning and closed loop control implementation. In a conventional locomotive, power is typically quantized to eight discrete levels. Modern locomotives can realize continuous variation in horsepower which may be incorporated into the previously described optimization methods. With continuous power, the locomotive 42 can further optimize operating conditions, e.g., by minimizing auxiliary loads and power transmission losses, and fine tuning engine horsepower regions of optimum efficiency, or to points of increased emissions margins. Example include, but are not limited to, minimizing cooling system losses, adjusting alternator voltages, adjusting engine speeds, and reducing number of powered axles. Further, the locomotive 42 may use the on-board track database 36 and the forecasted performance requirements to minimize auxiliary loads and power transmission losses to provide optimum efficiency for the target fuel consumption/emissions. Examples include, but are not limited to, reducing a number of powered axles on flat terrain and pre-cooling the locomotive engine prior to entering a tunnel.

Exemplary embodiments of the present invention may also use the on-board track database 36 and the forecasted performance to adjust the locomotive performance, such as to insure that the train has sufficient speed as it approaches a hill and/or tunnel. For example, this could be expressed as a speed constraint at a particular location that becomes part of the optimal plan generation created solving the equation (OP). Additionally, exemplary embodiments of the present invention may incorporate train-handling rules, such as, but not limited to, tractive effort ramp rates, maximum braking effort ramp rates. These may be incorporated directly into the formulation for optimum trip profile or alternatively incorporated into the closed loop regulator used to control power application to achieve the target speed.

In a preferred embodiment the present invention is only installed on a lead locomotive of the train consist. Even though exemplary embodiments of the present invention are not dependant on data or interactions with other locomotives, it may be integrated with a consist manager, as disclosed in U.S. Pat. No. 6,691,957 and patent application Ser. No. 10/429,596 (owned by the Assignee and both incorporated by reference), functionality and/or a consist optimizer functionality to improve efficiency. Interaction with multiple trains is not precluded as illustrated by the example of dispatch arbitrating two "independently optimized" trains described herein.

Trains with distributed power systems can be operated in different modes. One mode is where all locomotives in the train operate at the same notch command. So if the lead locomotive is commanding motoring—N8, all units in the train will be commanded to generate motoring—N8 power. Another mode of operation is "independent" control. In this mode, locomotives or sets of locomotives distributed throughout the train can be operated at different motoring or braking powers. For example, as a train crests a mountaintop, the lead locomotives (on the down slope of mountain) may be placed in braking, while the locomotives in the middle or at the end of the train (on the up slope of mountain) may be in motoring. This is done to minimize tensile forces on the mechanical couplers that connect the railcars and locomotives. Traditionally, operating the distributed power system in "independent" mode required the operator to manually command each remote locomotive or set of locomotives via a display in the lead locomotive. Using the physics based planning model, train set-up information, on-board track database, on-board operating rules, location determination system, real-time closed loop power/brake control, and sensor feedback, the system shall automatically operate the distributed power system in "independent" mode.

When operating in distributed power, the operator in a lead locomotive can control operating functions of remote locomotives in the remote consists via a control system, such as a distributed power control element. Thus when operating in distributed power, the operator can command each locomotive consist to operate at a different notch power level (or one consist could be in motoring and other could be in braking) wherein each individual locomotive in the locomotive consist operates at the same notch power. In an exemplary embodiment, with an exemplary embodiment of the present invention installed on the train, preferably in communication with the distributed power control element, when a notch power level for a remote locomotive consist is desired as recommended by the optimized trip plan, the exemplary embodiment of the present invention will communicate this power setting to the remote locomotive consists for implementation. As discussed below, the same is true regarding braking.

Exemplary embodiments of the present invention may be used with consists in which the locomotives are not contiguous, e.g., with 1 or more locomotives up front, others in the middle and at the rear for train. Such configurations are called distributed power wherein the standard connection between the locomotives is replaced by radio link or auxiliary cable to link the locomotives externally. When operating in distributed power, the operator in a lead locomotive can control operating functions of remote locomotives in the consist via a control system, such as a distributed power control element. In particular, when operating in distributed power, the operator can command each locomotive consist to operate at a different notch power level (or one consist could be in motoring and other could be in braking) wherein each individual in the locomotive consist operates at the same notch power.

In an exemplary embodiment, with an exemplary embodiment of the present invention installed on the train, preferably in communication with the distributed power control element, when a notch power level for a remote locomotive consist is desired as recommended by the optimized trip plan, the exemplary embodiment of the present invention will communicate this power setting to the remote locomotive consists for implementation. As discussed below, the same is true regarding braking. When operating with distributed power, the optimization problem previously described can be enhanced to allow additional degrees of freedom, in that each of the remote units can be independently controlled from the lead unit. The value of this is that additional objectives or constraints relating to in-train forces may be incorporated into the performance function, assuming the model to reflect the in-train forces is also included. Thus exemplary embodiments of the present invention may include the use of multiple throttle controls to better manage in-train forces as well as fuel consumption and emissions.

In a train utilizing a consist manager, the lead locomotive in a locomotive consist may operate at a different notch power setting than other locomotives in that consist. The other locomotives in the consist operate at the same notch power setting. Exemplary embodiments of the present invention may be utilized in conjunction with the consist manager to command notch power settings for the locomotives in the consist. Thus based on exemplary embodiments of the present invention, since the consist manager divides a locomotive consist into two groups, lead locomotive and trail units, the lead locomotive will be commanded to operate at a certain notch power and the trail locomotives are commanded to operate at another certain notch power. In an exemplary embodiment the distributed power control element may be the system and/or apparatus where this operation is housed.

Likewise, when a consist optimizer is used with a locomotive consist, exemplary embodiments of the present invention can be used in conjunction with the consist optimizer to determine notch power for each locomotive in the locomotive consist. For example, suppose that a trip plan recommends a notch power setting of 4 for the locomotive consist. Based on the location of the train, the consist optimizer will take this information and then determine the notch power setting for each locomotive in the consist. In this implementation, the efficiency of setting notch power settings over intra-train communication channels is improved. Furthermore, as discussed above, implementation of this configuration may be performed utilizing the distributed control system.

Furthermore, as discussed previously, exemplary embodiment of the present invention may be used for continuous corrections and re-planning with respect to when the train consist uses braking based on upcoming items of interest, such as but not limited to railroad crossings, grade changes, approaching sidings, approaching depot yards, and approaching fuel stations where each locomotive in the consist may require a different braking option. For example, if the train is coming over a hill, the lead locomotive may have to enter a braking condition whereas the remote locomotives, having not reached the peak of the hill may have to remain in a motoring state.

Figure 8:
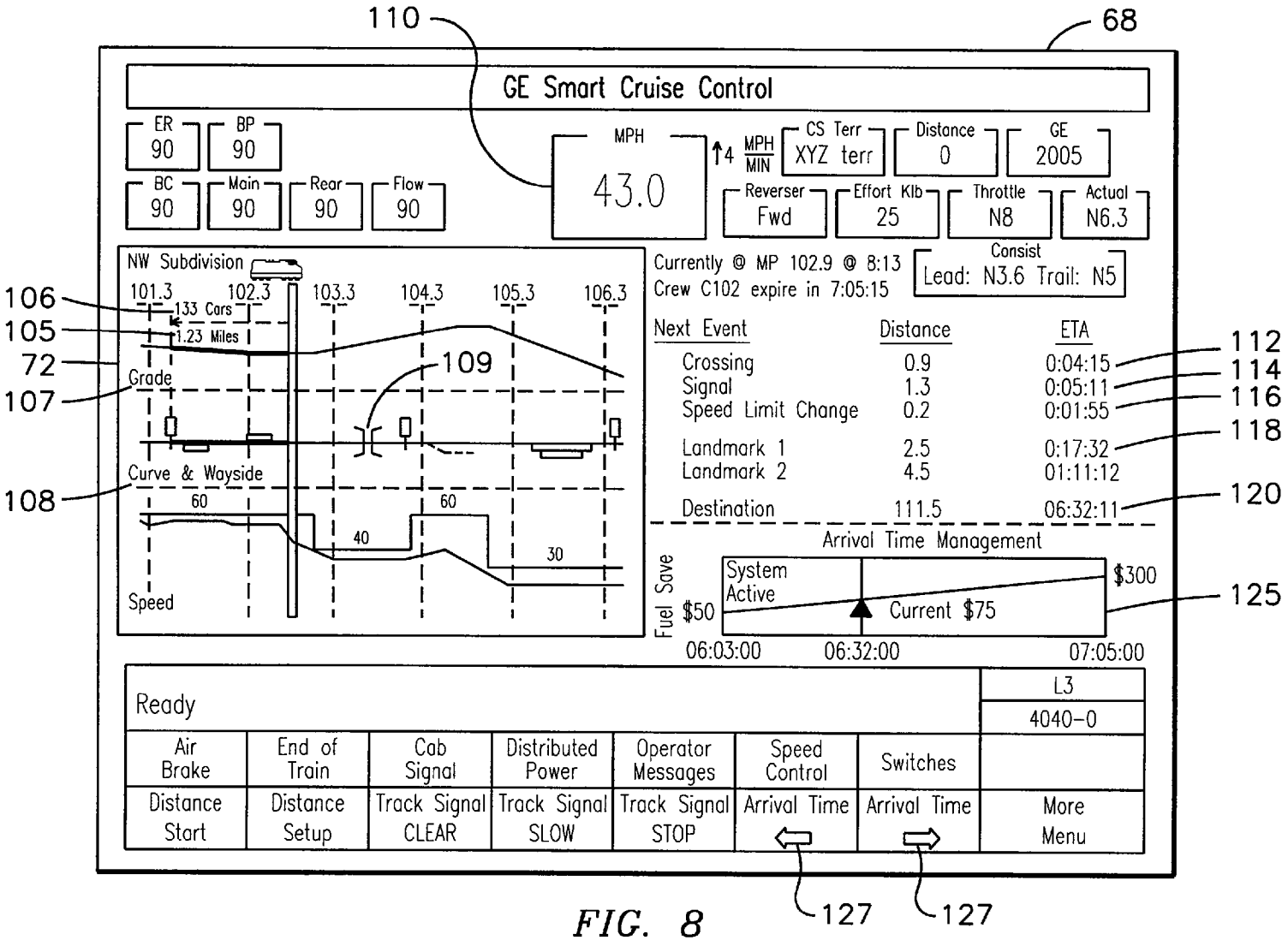
FIG. 8 depicts an exemplary illustration of a dynamic display for use by the operator.
Figure 9:
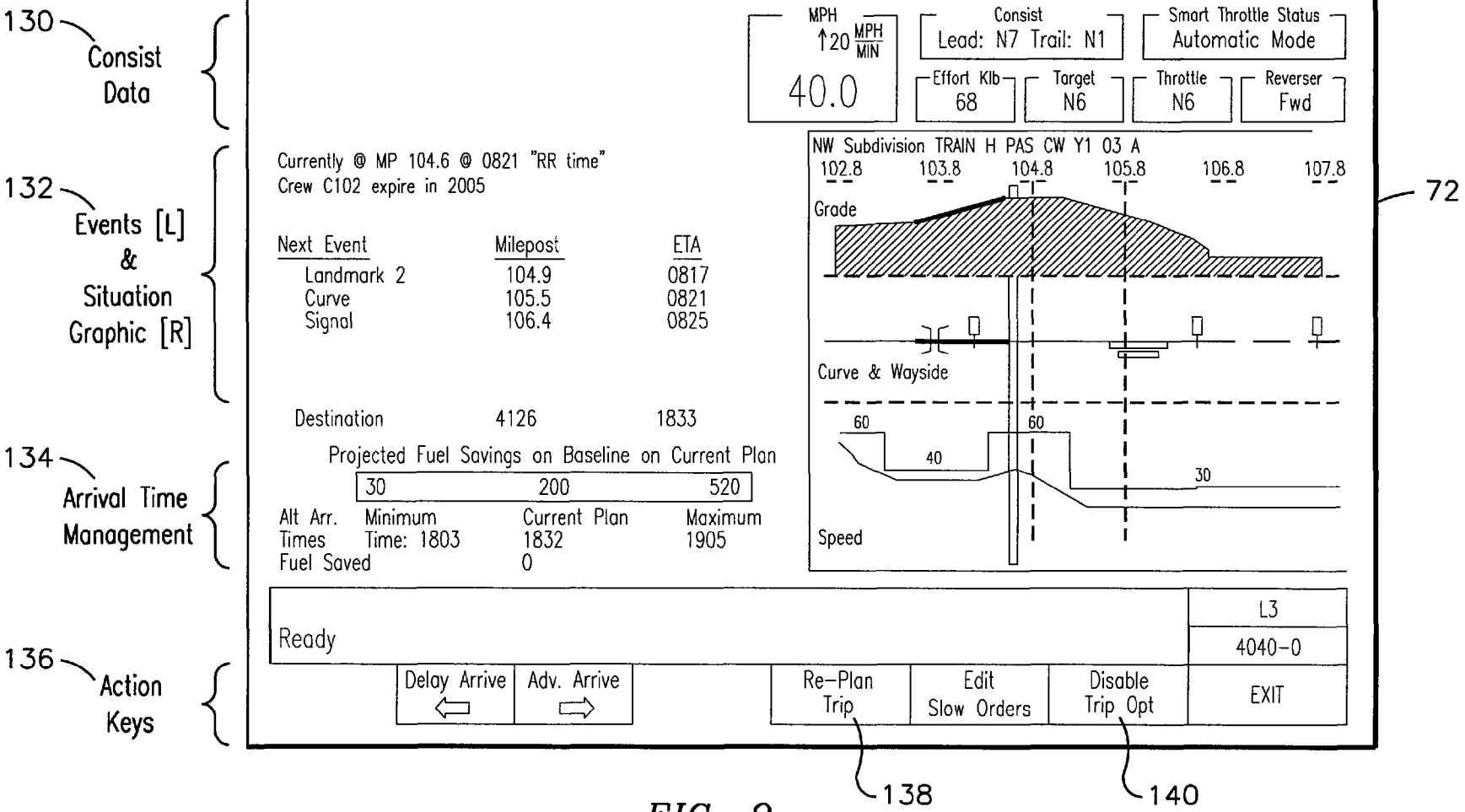
FIG. 9 depicts another exemplary illustration of a dynamic display for use by the operator.
Figure 10:
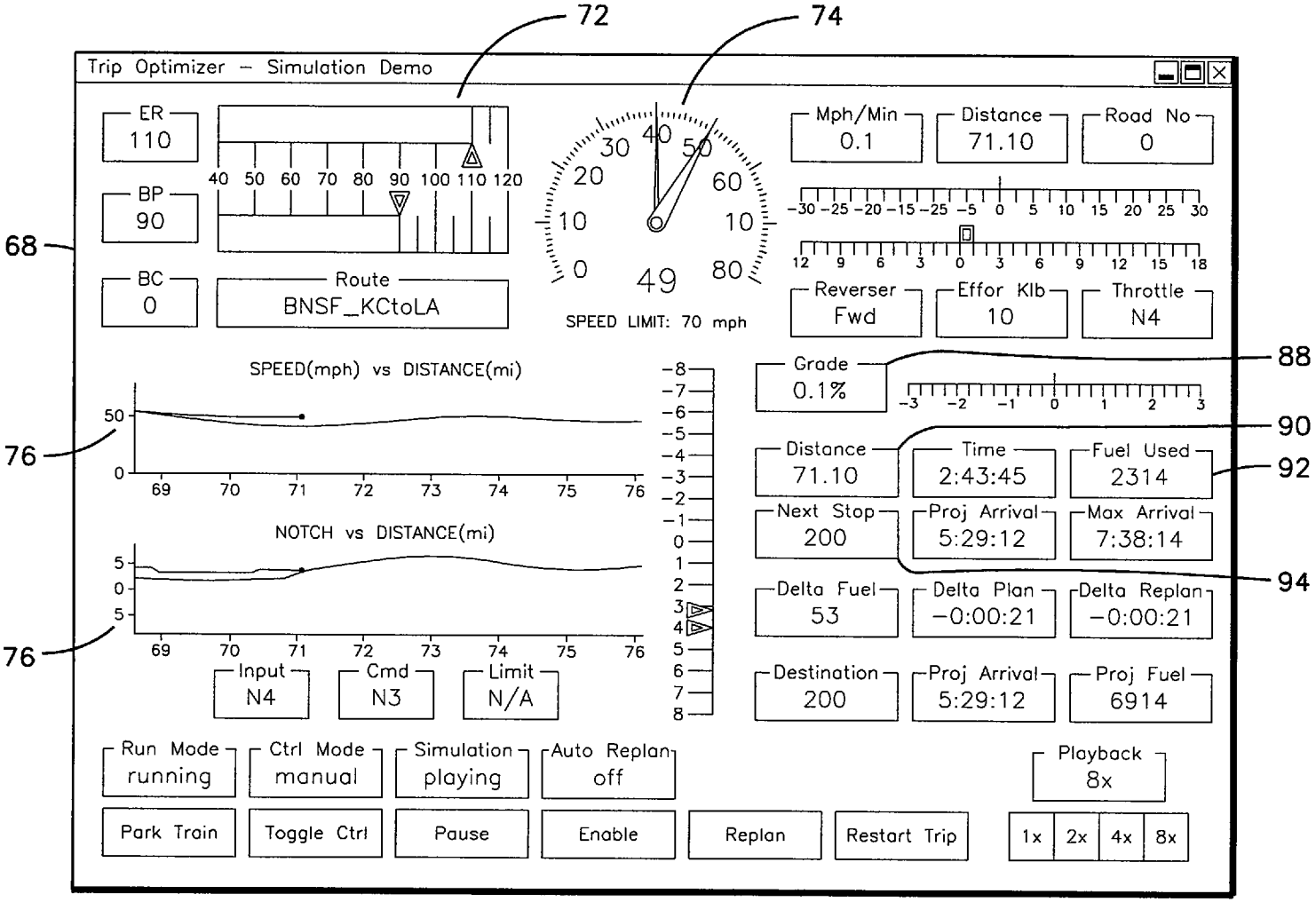
FIG. 10 depicts another exemplary illustration of a dynamic display for use by the operator.

FIGS. 8, 9 and 10 depict exemplary illustrations of dynamic displays for use by the operator. As provided, FIG. 8, a trip profile is provided 72. Within the profile a location 73 of the locomotive is provided. Such information as train length 105 and the number of cars 106 in the train is provided. Elements are also provided regarding track grade 107, curve and wayside elements 108, including bridge location 109, and train speed 110. The display 68 allows the operator to view such information and also see where the train is along the route. Information pertaining to distance and/or estimate time of arrival to such locations as crossings 112, signals 114, speed changes 116, landmarks 118, and destinations 120 is provided. An arrival time management tool 125 is also provided to allow the user to determine the fuel savings that is being realized during the trip. The operator has the ability to vary arrival times 127 and witness how this affects the fuel savings. As discussed herein, those skilled in the art will recognize that fuel saving is an exemplary example of only one objective that can be reviewed with a management tool. Towards this end, depending on the parameter being viewed, other parameters, discussed herein can be viewed and evaluated with a management tool that is visible to the operator. The operator is also provided information about how long the crew has been operating the train. In exemplary embodiments time and distance information may either be illustrated as the time and/or distance until a particular event and/or location or it may provide a total elapsed time.

As illustrated in FIG. 9 an exemplary display provides information about consist data 130, an events and situation graphic 132, an arrival time management tool 134, and action keys 136. Similar information as discussed above is provided in this display as well. This display 68 also provides action keys 138 to allow the operator to re-plan as well as to disengage 140 exemplary embodiments of the present invention.

FIG. 10 depicts another exemplary embodiment of the display. Data typical of a modern locomotive including air-brake status 72, analog speedometer with digital inset 74, and information about tractive effort in pounds force (or traction amps for DC locomotives) is visible. An indicator 74 is provided to show the current optimal speed in the plan being executed as well as an accelerometer graphic to supplement the readout in mph/minute. Important new data for optimal plan execution is in the center of the screen, including a rolling strip graphic 76 with optimal speed and notch setting versus distance compared to the current history of these variables. In this exemplary embodiment, location of the train is derived using the locator element. As illustrated, the location is provided by identifying how far the train is away from its final destination, an absolute position, an initial destination, an intermediate point, and/or an operator input.

The strip chart provides a look-ahead to changes in speed required to follow the optimal plan, which is useful in manual control, and monitors plan versus actual during automatic control. As discussed herein, such as when in the coaching mode, the operator can either follow the notch or speed suggested by exemplary embodiments of the present invention. The vertical bar gives a graphic of desired and actual notch, which are also displayed digitally below the strip chart. When continuous notch power is utilized, as discussed above, the display will simply round to closest discrete equivalent, the display may be an analog display so that an analog equivalent or a percentage or actual horse power/tractive effort is displayed.

Critical information on trip status is displayed on the screen, and shows the current grade the train is encountering 88, either by the lead locomotive, a location elsewhere along the train or an average over the train length. A distance traveled so far in the plan 90, cumulative fuel used 92, where or the distance away the next stop is planned 94, current and projected arrival time 96 expected time to be at next stop are also disclosed. The display 68 also shows the maximum possible time to destination possible with the computed plans available. If a later arrival was required, a re-plan would be carried out. Delta plan data shows status for fuel and schedule ahead or behind the current optimal plan. Negative numbers mean less fuel or early compared to plan, positive numbers mean more fuel or late compared to plan, and typically trade-off in opposite directions (slowing down to save fuel makes the train late and conversely).

At all times these displays 68 gives the operator a snapshot of where he stands with respect to the currently instituted driving plan. This display is for illustrative purpose only as there are many other ways of displaying/conveying this information to the operator and/or dispatch. Towards this end, the information disclosed above could be intermixed to provide a display different than the ones disclosed.

Other features that may be included in exemplary embodiments of the present invention include, but are not limited to, allowing for the generating of data logs and reports. This information may be stored on the train and downloaded to an off-board system at some point in time. The downloads may occur via manual and/or wireless transmission. This information may also be viewable by the operator via the locomotive display. The data may include such information as, but not limited to, operator inputs, time system is operational, fuel saved, fuel imbalance across locomotives in the train, train journey off course, system diagnostic issues such as if GPS sensor is malfunctioning.

Since trip plans must also take into consideration allowable crew operation time, exemplary embodiments of the present invention may take such information into consideration as a trip is planned. For example, if the maximum time a crew may operate is eight hours, then the trip shall be fashioned to include stopping location for a new crew to take the place of the present crew. Such specified stopping locations may include, but are not limited to rail yards, meet/pass locations, etc. If, as the trip progresses, the trip time may be exceeded, exemplary embodiments of the present invention may be overridden by the operator to meet criteria as determined by the operator. Ultimately, regardless of the operating conditions of the train, such as but not limited to high load, low speed, train stretch conditions, etc., the operator remains in control to command a speed and/or operating condition of the train.

Using exemplary embodiments of the present invention, the train may operate in a plurality of operations. In one operational concept, an exemplary embodiment of the present invention may provide commands for commanding propulsion, dynamic braking. The operator then handles all other train functions. In another operational concept, an exemplary embodiment of the present invention may provide commands for commanding propulsion only. The operator then handles dynamic braking and all other train functions. In yet another operational concept, an exemplary embodiment of the present invention may provide commands for commanding propulsion, dynamic braking and application of the airbrake. The operator then handles all other train functions.

Exemplary embodiments of the present invention may also be used by notify the operator of upcoming items of interest of actions to be taken. Specifically, the forecasting logic of exemplary embodiments of the present invention, the continuous corrections and re-planning to the optimized trip plan, the track database, the operator can be notified of upcoming crossings, signals, grade changes, brake actions, sidings, rail yards, fuel stations, etc. This notification may occur audibly and/or through the operator interface.

Specifically using the physics based planning model, train set-up information, on-board track database, on-board operating rules, location determination system, real-time closed loop power/brake control, and sensor feedback, the system shall present and/or notify the operator of required actions. The notification can be visual and/or audible. Examples include notifying of crossings that require the operator activate the locomotive horn and/or bell, notifying of "silent" crossings that do not require the operator activate the locomotive horn or bell.

In another exemplary embodiment, using the physics based planning model discussed above, train set-up information, on-board track database, on-board operating rules, location determination system, real-time closed power/brake control, and sensor feedback, exemplary embodiments of the present invention may present the operator information (e.g. a gauge on display) that allows the operator to see when the train will arrive at various locations as illustrated in FIG. 9. The system shall allow the operator to adjust the trip plan (target arrival time). This information (actual estimated arrival time or information needed to derive off-board) can also be communicated to the dispatch center to allow the dispatcher or dispatch system to adjust the target arrival times. This allows the system to quickly adjust and optimize for the appropriate target function (for example trading off speed and fuel usage).

Generally speaking, train operations may be improved based on knowledge of rail car parameters of rail cars making up a train. These parameters may include weight, number of axles, type and characteristics of couplers, speed limits, axial load, friction, wind resistance, wheel axial loads, vertical loads, and lateral loads on the rail. The individual car parameters, in turn, may have an effect on train loading capacity. For example, a set of lightly loaded cars in the center of a train with heavily loaded cars behind can lead to higher derailment potential when accelerating or pulling hard in a curve. Additionally, knowledge of the total carload allows optimization of speed versus fuel consumption of the train and emissions of the train. Also, knowledge of rail car parameters may also result in faster dispatch from rail yards.

In another exemplary embodiment, information about cargo data may also be included as rail car parameters. This information could include the quantity and type of cargo. For example, suppose a car carried liquid. If the car was not full, then the movement of the liquid may have an effect of the total forces that can be put on the wheel or couplers. This information may be used to further optimize train operations. Likewise, suppose a car carried hazardous material. Since certain speed limit restrictions may be required, this information may be used to further optimize train operations. When cargo data is not available, a sensor may be used to detect a change in loads, such as load changes realized by a partially filled liquid carrying car. In operation, the train is slowed and the axle load change is measured. In another exemplary embodiment, a hump, such as found in a hump yard, is introduced in the path of the car wherein the axle load change is measured. Knowing the displacement of the liquid and how it affects axle load can be factored in to insure that maximum acceleration and deceleration limits are established by train optimization routines disclosed above.

In another exemplary embodiment, with a sensor detecting axle load, an unexpected change in axle load may illustrate an unexpected cargo shift. Using a signature analysis system, distinguishing between liquid displacements and shifting of fixed cargo, such as but not limited to a loose box, is possible. The signature analysis system would detect shifting of fixed cargo as having a high frequency spectrum whereas liquid movement would display as a broader frequency spectrum.

Providing the car characteristics to a train makeup and manifest automatically may advantageously reduce yard setup time and allow overall rail yard network optimization, where a tradeoff can be made between setup time where cars are arranged in an optimal manner and often have to be re-sequenced, thus increasing yard time. The overall setup time can be traded off against train run time. Providing the car characteristics allows generation of train manifest with details of car characteristics and issue to crew, dispatch and unloading. Providing the car characteristics allows a load characterization of cars in a train to be formulated for weight, resistance, curve performance, allows train handling with and without DP to be optimized, allows to put cars together in the train and de-clutter yards for increased network traffic capabilities, allows reduction of possibility of derailment due to knowledge of car load and performance by adjustment of train handling parameters such as acceleration, deceleration and speed, allows car performance as limiting factor to be entered for train speed/fuel optimization and/or improved emissions, may enable realization of a one man crew, and allows optimization of cruise control.

A railroad car characterization system and method is disclosed herein that automatically determines the car parameters, such as weight, load, wheel axial, lateral and vertical forces. The rail car parameters may be provided during train makeup in a rail yard, such as a hump yard, over the road and/or or on sidings. The rail car parameters may be used for train manifest characterization and may be linked to railroad efficiency tools, such as cruise control to allow fuel/speed optimization for acceleration and/or improved emission, deceleration, improved train handling of DP or non DP trains. The rail car parameters may allow train fuel versus speed to be optimized by taking train-handling constraints into account that may limit speed, acceleration or deceleration, such as for DP and non-DP operation. The rail car parameters may allow determining tradeoffs between over road train delivery time versus yard train makeup time to improve overall goods delivery efficiency. The rail car parameters may be used to provide train manifest data that incorporates car performance characteristics responsive weight, lateral, axial and vertical axle loads and forces of the car. As described herein, the cars parameter determination may be performed automatically.

Certain types of cars may be susceptible to wind and/or air resistance. For example, unloaded lumber carrying cars have large surfaces that can act as sails that affect movement of the car. In one aspect, a measured rail car parameter may include determining a wind resistance factor of the rail car. Accordingly, a type of car and corresponding wind resistance factor and/or wind resistance measurement parameters may be included in the measurement data, such as via a visual observer of the car at trackside during a measurement gathering process.

Figure 11:
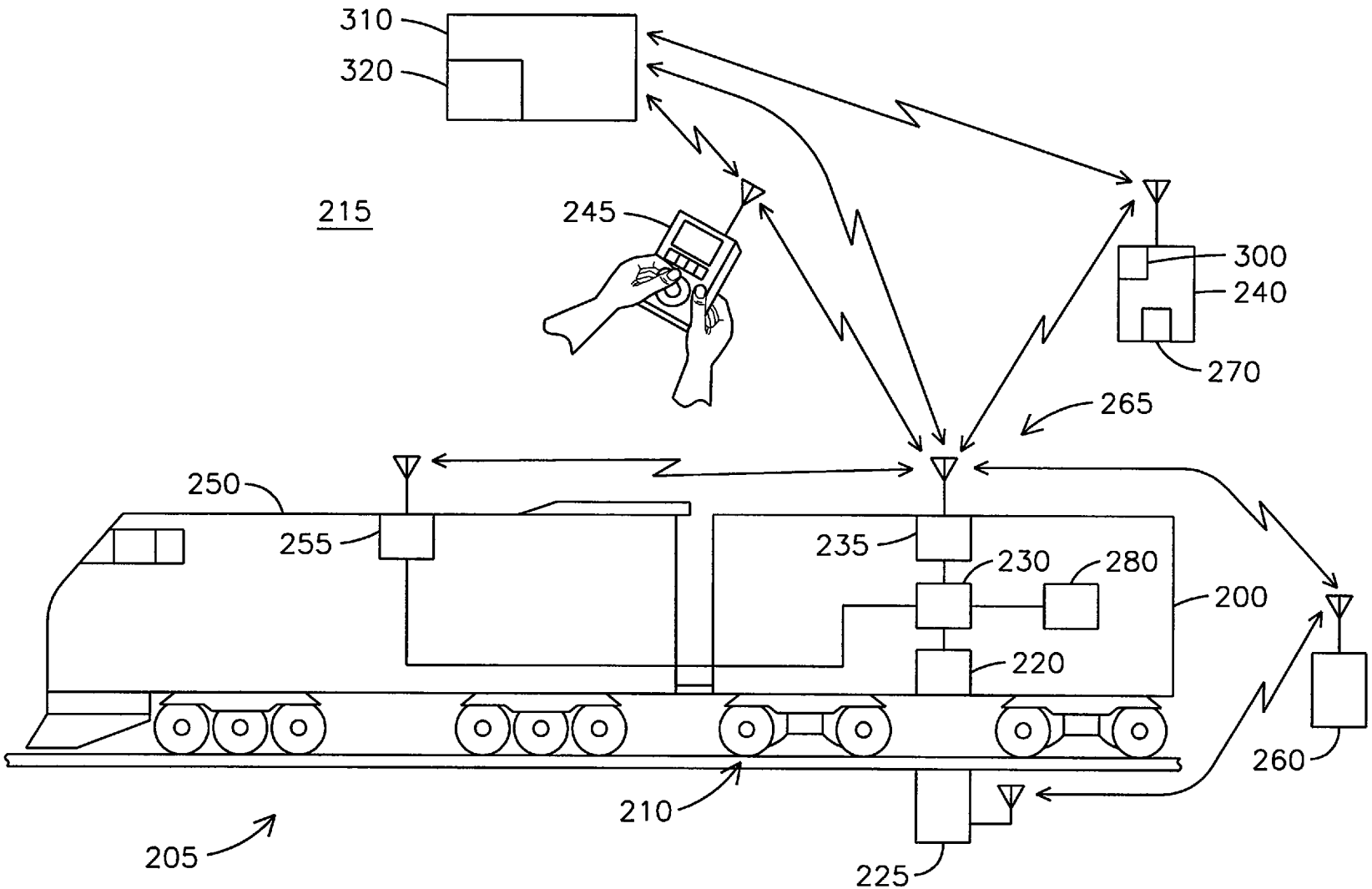
FIG. 11 depicts a schematic representation of a system for automatically identifying rail car parameters used in improving train operations.

In an exemplary embodiment depicted in FIG. 11, rail car parameters of a rail car 200 may be obtained in a rail yard 205 where parameters such as car weight and wheel forces may be measured when traversing a predetermined track portion 216, such as a straight portion or a curved portion. A rail car parameter measurement system 215 (or measurement system) is provided and may include an on-board sensor 220 and/or an off-board sensor 225, such as force sensors, for measuring forces on the track, the wheels, the suspension and/or combinations thereof. Other sensors may include deflection detectors, springs, laser gauges, etc. The measurement system 215 may include a data collection module 230 for collecting measurement data and may be in communication via transceiver 235 with a central controller 240, such as car dispatch system, train makeup/manifest system, and may provide the measurement data to the network dispatch system as well as a train speed/fuel efficiency optimization system. The measurement system may also be in communication with and provide measurement information to a portable data collection unit 245, a locomotive 250 via locomotive transceiver 255, a wayside electronics unit 260, and an off board sensor 225. Together, these systems may share information in a communications network, wherein the elements may communicate with one another to exchange information. Such communications may be provided wirelessly coupled, such as via RF or infrared communication, or may be hardwired, such as a hardwire connection between the rail car and the locomotive 250.

In another embodiment, the measurement system 215 may be implemented outside of a rail yard, such as on a siding remote from the rail yard. Measurement data may therefore be obtained after the train has left the rail yard 205 and the measurement data may be fed to the network 265 and central controller 240 after assembly of the train in the yard for further action.

In an aspect of the invention, the central controller 240 may include a processor 270 for processing the measurement data provided for a train to provide an acceleration/deceleration optimization factor to ensure that train operating parameters take these limitations into account. In case of an optimized car makeup acceleration/deceleration can be increased to reduce mission time, given an additional parameter for optimization. In the case of distributed power (DP) trains, the normal reduced tractive effort (TE) of rear units of the train can be better matched to a front unit as a result of the measurement data provided for rail cars of the train.

In another exemplary embodiment a signature analysis system 300 is provided. This system 300 may be part of or in communication with the controller 240. As discussed above, the signature analysis system 300 may be used to distinguish between liquid displacement and shifting fixed cargo.

Additionally, previously acquired measurement data may be used to determine unusual car performance such as high wheel friction that can be attributed to bearing issues by comparing current data to the previously measured data. This allows maintenance to be performed prior to coupling the car to the train.

Advantageously, the system may provide a capability to trade off yard train makeup time versus train run time, a capability to optimize power settings of locomotives of trains, such as for DP trains, a capability to add more cars for a given locomotive power based on a measured or anticipated car load, a capability to optimize fuel/speed settings, and provide car diagnostics, such as excessive friction, wheel flat spots, etc.

In an aspect of the invention, the onboard sensor may include a weight sensor such as a scale, or a spring deflection sensor on the rail car. The off board sensor 225 may include a force gauge on the track 210 over which the rail car travels. In an aspect of the invention, the weight may be measured when accelerating or decelerating a car on the track with known friction load (deceleration) or power applied (accelerating) such as determined by using an accelerometer on the rail car.

For curved rail measurement sections, the onboard sensor 220 may include a force detector to detect wheel forces, such as a vertical, axial, and/or horizontal force gauge. In another embodiment, the onboard sensor 220 may include a deflection (movement) sensor that monitors a wheel when going around a curve; for example, for observing reduction of speed when going around the curve and may include a heat sensor for detection of heat dissipated when going around curve. The off board sensor 225 may include a force gauge on the rail 210 to detect deflection of the rail and/or a force gauge on a switch over which the rail car is traveling.

For straight rail measurement sections, the onboard sensor 220 may include a force detector to detect wheel forces, such as a vertical, axial, and/or horizontal force gauge or accelerometers. The off board sensor 225 may include a force gauge/accelerometer on the rail, a deflection/accelerometer of rail, and/or a force gauge on a switch. In another embodiment, the onboard sensor 220 may include a deflection (movement) sensor that monitors the wheel when on straight rail, calculated by observing reduction of speed when going around a predetermined straight run and may include a heat sensor for detection of heat dissipated when on straight run.

Data collection may be performed by the on board data collection system 230 or may be performed remotely, such as by using portable data collection unit 245. The network 265 may include one or more of the following types of networks: wired, wireless, real time, batch data transfer, store and forward, data push (when data is available), data pull (ask prompt for action either real time or delayed), and/or manual entry.

In other embodiments, data readout of measurement data from the system may be provided by electronic and hard linked to central controller 240 such as yard/dispatch system, electronic with manual linkage, electronic with readout and manual entry to another system, mechanical and hard linked to yard/dispatch system, mechanical with manual linkage, mechanical with readout, and/or manual entry to other systems. Rail car identification for use by the system may be input into the system manually or via a rail car identifier 280 that may include an electronic tag, radio frequency (RF) tag, and/or barcode.

In other example embodiments, the measurement system configuration may include manual yard dispatch with electronic data entry, manual yard dispatch with manual data entry, electronic yard dispatch with manual data entry, electronic yard dispatch with electronic data entry, manual manifest makeup, electronic manifest makeup, manual network system with data from manual yard system calculation manual/lookup/electronic, manual network system with data from electronic yard system calculation manual/lookup/electronic, electronic network system with data from manual yard system calculation manual/lookup/electronic, electronic network system with data from electronic yard system calculation manual/lookup/electronic, manual trip optimizer with data from manual yard system calculation manual/lookup/electronic, manual trip optimizer with data from electronic yard system calculation manual/lookup/electronic, electronic trip optimizer with data from manual yard system calculation manual/lookup/electronic, electronic trip optimizer with data from electronic yard system calculation manual/lookup/electronic, manual trip optimizer with data from manual over the road/siding/switch system calculation manual/lookup/electronic, manual trip optimizer with data from electronic over the road/siding/switch system calculation manual/lookup/electronic, electronic trip optimizer with data from manual over the road/siding/switch system calculation manual/lookup/electronic, and/or electronic trip optimizer with data from electronic over the road/siding/switch system calculation manual/lookup/electronic.

The measurement data acquired by the system may be used for controlling an operation of a train to limit an operation parameter, equalize operating parameters, relax parameter limits, optimize operation parameters prior to trip/for setup, optimize operation parameters in real time, optimize operation parameters for entire run, optimize operation parameters for sections of run, optimize operation parameters with a single input, optimize operation parameters with multiple data input sets, and/or optimize diagnostics and car maintenance.

The data sources used for storing data in the system may include wayside electronics units 260, car electronics, such as data collection unit 230, locomotive 250, and/or central controller 240, such as a yard system or dispatch system. The data receivers used for receiving measurement data may include offline host, online loco system, online yard system, offline yard system, online dispatch system, offline dispatch system, online wayside equipment, offline wayside equipment, online network optimizer, offline network optimizer and/or billing systems.

Optimization techniques that may be used to process the measurement data to generate optimized operation parameters may include relaxation with successive approximation, time sequence Taylor series, neural nets, transforms, experience based lookup tables, first principle force based techniques, and or Kalman filtering.

In an exemplary embodiment, a remote location, such as but not limited to a regional and/or national center 310 is provided that maintains a national database 320 of rail car information. This national database 320 may be used as a resource in train building. It may also be used for model analysis. Because of the type of information provided, this database 320 may also be used by government agencies to address transportation requirements and/or security concerns. Information from the national database is communicated between itself and the controller 240. When new information is obtained from the controller 240, the information in the national database 320 is updated. The communications between the controller 248 and national database 320 may be protected, such as but not limited to encryption and/or authentication techniques. In another exemplary embodiment, there may be a plurality of regional databases that communicate with each other as disclosed above with respect to the national database communicating with the controller 240. In an exemplary embodiment the network 265 through which the communications occurs may be protected against surreptitious attacks from outside agents.

Figure 12:
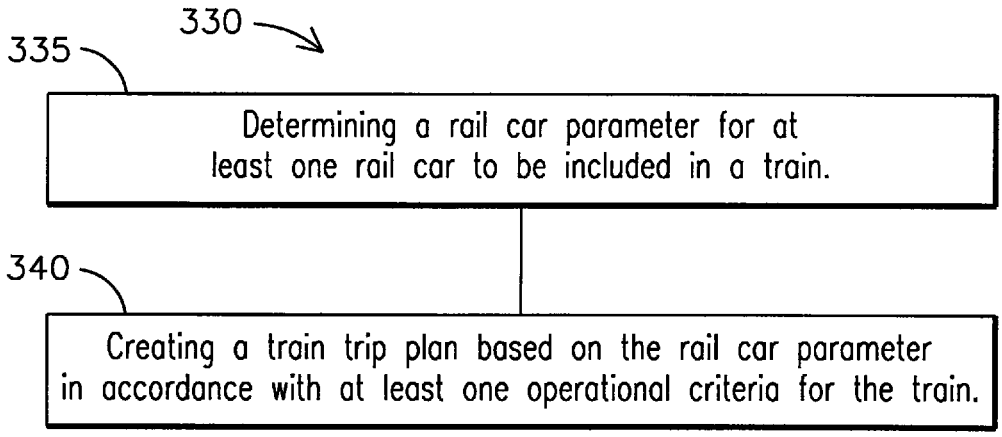
FIG. 12 depicts a flow chart illustrating steps for automatically identifying rail car parameters used in improving train operations.

FIG. 12 depicts a flow chart illustrating steps for identifying rail car parameters used in improving train operations. Those skilled in the art will readily recognize that these steps in the flowchart 330 may be taken automatically and/or autonomously. The steps include determining a rail car parameter of a rail car of a train, step 335, and creating a trip plan based on the rail car parameter in accordance with at least one operational criterion for the train, step 340. Additional steps may include locating a rail car within the train based on at least one rail car parameter. Furthermore as discussed above, the order of rail cars in the train may be established based on rail car parameters. As is also disclosed above, these steps, steps 335 and/or 334 may be implemented using a computer software code and/or another processor implemented technique.

In another exemplary embodiment wayside automatic equipment identification (AEI) tag readers, which are part of a rail classification system, are used to read information, usually manifest information, from the rail cars. Rail classification systems need to have reliable manifests to accomplish the tasks of sorting and forwarding rail cars. Most systems get these manifests from databases on a corporate network. After a train is built, a list of the cars in that train is uploaded to a database by yard personnel and/or AEI systems. Therefore information may be read from rail vehicles as it passes AEI tag readers, usually once the complete train has passed. In an exemplary embodiment, the information read is transmitted to the locomotive, more specifically the trip optimizer, where the information is used to update a trip plan and/or for use in creating a future trip plan. Information can be updated as rail cars are added and/or dropped off at intended destinations.

While the invention has been described with reference to an exemplary embodiment, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A method comprising:

determining a parameter for at least one non-locomotive car to be included in a train, the parameter including at least one of an axial load of the non-locomotive car other than a total weight of the non-locomotive car; and creating a train trip plan, by one or more processors in operative communication with the train, based on the parameter in accordance with at least one operational criteria for the train.

2. The method according to claim 1, wherein the parameter for the non-locomotive car also includes at least one of the total weight, a friction, or a wind resistance of the non-locomotive car.

3. The method according to claim 1, further comprising determining, by the one or more processors, a location for the non-locomotive car within the train based on the parameter.

4. The method according to claim 1, further comprising controlling, by the one or more processors, at least one of speed versus fuel consumption of the train or emission output of the train based on the parameter.

5. The method according to claim 1, further comprising communicating the parameter to a remote central database.

6. The method according to claim 5, further comprising protecting communication of the parameter with the remote central database.

7. The method according to claim 1, further comprising determining, by the one or more processors, whether a change in the axial load of the non-locomotive car is caused by at least one of liquid displacement within the non-locomotive car or shifting cargo on the non-locomotive car.

8. The method according to claim 1, further comprising reducing yard setup time of the train based on the parameter.

9. The method according to claim 1, further comprising determining, by the one or more processors, a load characterization of the non-locomotive car in the train based on at least one of weight, resistance, or curve performance.

10. The method according to claim 1, wherein the train is a distributed power train and the method further comprises controlling operating performance of the distributed power train based on the parameter for the non-locomotive car.

11. The method according to claim 1, wherein the non-locomotive car is a first non-locomotive car of a plurality of non-locomotive cars, and further comprising arranging the non-locomotive cars in the train based on the parameter for the first non-locomotive car.

12. The method according to claim 1, further comprising operating the train, by the one or more processors, based on the train trip plan that is created.

13. The method according to claim 1, wherein determining the parameter further comprises determining the parameter for the non-locomotive car by traversing a predetermined track portion.

14. The method according to claim 1, further comprising determining data, by the one or more processors, for the non-locomotive car by reading information contained on an identification tag attached to the non-locomotive car.

15. The method according to claim 1, wherein the axial load is a vertical axial load.

16. A non-transitory computer readable medium for use in a processor, the non-transitory computer readable medium comprising one or more computer software modules that direct the processor to:

determine a parameter of at least one non-locomotive car of the train, the parameter including at least one of an axial load of the non-locomotive car other than a total weight of the non-locomotive car; and create a train trip plan based on the parameter for the non-locomotive car in accordance with at least one operational criteria for the train.

17. The non-transitory computer readable medium according to claim 16, wherein the parameter for the non-locomotive car includes at least one of the total weight, a friction, or a wind resistance of the non-locomotive car.

18. The non-transitory computer readable medium according to claim 16, wherein the one or more computer software modules direct the processor to determine a location of the non-locomotive car within the train based on the parameter.

19. The non-transitory computer readable medium according to claim 16, wherein the one or more computer software modules direct the processor to control at least one of speed versus fuel consumption of the train or emission output of the train based on the parameter for the non-locomotive car.

20. The non-transitory computer readable medium according to claim 16, wherein the one or more computer software modules direct the processor to communicate the parameter for the non-locomotive car to a remote central database.

21. The non-transitory computer readable medium according to claim 20, wherein the one or more computer software modules direct the processor to protect communication with the remote central database.

22. The non-transitory computer readable medium according to claim 17, wherein the one or more computer software modules direct the processor to determine whether a change in the axial load of the non-locomotive car is caused by at least one of liquid displacement within the non-locomotive car or shifting fixed cargo on the non-locomotive car.

23. The non-transitory computer readable medium according to claim 16, wherein the one or more computer software modules direct the processor to determine a load characterization of the non-locomotive car in the train based on at least one of weight, resistance, or curve performance.

24. The non-transitory computer readable medium according to claim 16, wherein the train is a distributed power train and the one or more computer software modules direct the processor to control operating performance of the distributed power train based on the parameter of the non-locomotive car.

25. The non-transitory computer readable medium according to claim 16, wherein the non-locomotive car is a first non-locomotive car of a plurality of non-locomotive cars in the train, and wherein the one or more computer software modules direct the processor to determine an order of the non-locomotive cars in the train based on the parameter of the non-locomotive car.

26. The non-transitory computer readable medium according to claim 16, wherein the one or more computer software modules direct the processor to operate the train based on the train trip plan created.

27. The non-transitory computer readable medium according to claim 16, wherein the one or more computer software modules direct the processor to determine data associated with the non-locomotive car by reading information contained on an identification tag attached to the non-locomotive car.

28. The computer software code according to claim 16, wherein the axial load is a lateral axial load.

29. A system comprising:

a parameter measurement system for measuring at least one parameter associated with a first non-locomotive car of a plurality of non-locomotive cars of a train, the parameter including at least-one of an axial load of the first non-locomotive car other than a total weight of the first non-locomotive car; and a controller configured to communicate with the parameter measurement system using a communication network;

wherein the parameter measurement system is configured to provide the parameter of the non-locomotive car to the controller and the controller is configured to determine at least one of a train make up profile for the plurality of non-locomotive cars in the train or a trip plan for a train mission based on the parameter.

30. The system according to claim 29, wherein the parameter measurement system further comprises at least one of an on-board sensor or an off-board sensor to determine the parameter for the first non-locomotive car.

31. The system according to claim 30, wherein the at least one of the on-board sensor or the off-board sensor is configured to determine at least one of the total weight, a friction, or a wind resistance of the first non-locomotive car.

32. The system according to claim 29, further comprising at least one of a remote database or a portable data collection unit configured to receive the parameter from the parameter measurement system.

33. The system according to claim 32, wherein at least two of the parameter measurement system, the controller, the remote database, the portable data collection unit, a wayside device, an off-board sensor, a locomotive, or the non-locomotive car communicate using the communication network.

34. The system according to claim 32, wherein the communication network is a protected communication network.

35. The system according to claim 29, wherein the controller comprises a processor.

36. The system according to claim 32, wherein the remote database comprises a plurality of the parameters measured for a plurality of rail cars of the rain.

37. The system according to claim 29, further comprising:

an identification marker configured to be attached to the non-locomotive car; and an identification marker reader configured to be located proximate a track traversable by the non-locomotive car for collecting information from the marker;

wherein the controller is configured to communicate with the identification marker reader and to use the information obtained from the marker to determine one or more characteristics of the non-locomotive car.

38. The system according to claim 37, wherein the information associated with the identification marker is provided to a trip optimizer for use in determining a trip plan.

39. The system according to claim 29, wherein the axial load is at least one of a vertical axial load or a lateral axial load.

* * * * *